US010551058B2

(12) United States Patent
Lang, Sr. et al.

(10) Patent No.: US 10,551,058 B2
(45) Date of Patent: Feb. 4, 2020

(54) MULTI-NOZZLE COMBUSTION ASSEMBLIES INCLUDING PERFORATED FLAME HOLDER, COMBUSTION SYSTEMS INCLUDING THE COMBUSTION ASSEMBLIES, AND RELATED METHODS

(71) Applicant: ClearSign Combustion Corporation, Seattle, WA (US)

(72) Inventors: Jerry Michael Lang, Sr., Lindale, TX (US); Douglas Wayne Karkow, Des Moines, WA (US); Donald Kendrick, Bellevue, WA (US); James Kyle Dansie, Seattle, WA (US); Terry Lynn Montgomery, Hawkins, TX (US); Jesse Dumas, Seattle, WA (US); Christopher A. Wiklof, Everett, WA (US)

(73) Assignee: CLEARSIGN TECHNOLOGIES CORPORATION, Seattle, WA (US)

( * ) Notice: Subject to any disclaimer, the term of this patent is extended or adjusted under 35 U.S.C. 154(b) by 299 days.

(21) Appl. No.: 15/455,469

(22) Filed: Mar. 10, 2017

(65) Prior Publication Data

US 2017/0268772 A1 Sep. 21, 2017

Related U.S. Application Data

(60) Provisional application No. 62/310,433, filed on Mar. 18, 2016.

(51) Int. Cl.
*F23D 14/70* (2006.01)
*F27B 1/10* (2006.01)

(52) U.S. Cl.
CPC ..... *F23D 14/70* (2013.01); *F27B 1/10* (2013.01); *F27D 2201/00* (2013.01)

(58) Field of Classification Search
CPC ..... F23D 14/70; F23D 14/14; F23D 14/02; F23D 14/145; F23D 2203/104;
(Continued)

(56) References Cited

U.S. PATENT DOCUMENTS 4,021,188 A 5/1977 Yamagishi et al.
4,081,958 A 4/1978 Schelp
(Continued)

FOREIGN PATENT DOCUMENTS

EP 1916477 4/2008
JP 2006-275482 10/2006
(Continued)

OTHER PUBLICATIONS

Fric, Thomas F., "Effects of Fuel-Air Unmixedness on NOx Emissions," Sep.-Oct. 1993. Journal of Propulsion and Power, vol. 9, No. 5, pp. 708-713.

*Primary Examiner* — Alfred Basichas
(74) *Attorney, Agent, or Firm* — Dorsey & Whitney LLP

(57) ABSTRACT

Embodiments disclosed herein are directed to integrated combustion assemblies including a perforated flame holder, combustion systems that include one or more integrated combustion assemblies, and related methods. For example, an integrated combustion assembly may be placed into service (e.g., integrated into a combustion system) as a complete and/or replaceable unit, such that elements and/or components of the combustion assembly are preassembled and no further assembly is required at the installation site.

26 Claims, 13 Drawing Sheets

(58) Field of Classification Search
CPC ..... F23D 2207/00; F23D 2203/105; F23D 2203/102; F27B 1/10; F27D 2201/00
See application file for complete search history.

(56) References Cited

U.S. PATENT DOCUMENTS

| | | | |
|---|---|---|---|
| 4,408,461 | A | 10/1983 | Bruhwiler et al. |
| 4,588,373 | A | 5/1986 | Tonon et al. |
| 4,673,349 | A | 6/1987 | Abe et al. |
| 4,752,213 | A | 6/1988 | Grochowski et al. |
| 5,326,257 | A | 7/1994 | Taylor et al. |
| 5,375,999 | A | 12/1994 | Aizawa et al. |
| 5,441,402 | A | 8/1995 | Reuther et al. |
| 5,641,282 | A | 6/1997 | Lee et al. |
| 5,957,682 | A | 9/1999 | Kamal et al. |
| 6,095,798 | A | 8/2000 | Mitani et al. |
| 9,377,190 | B2 | 6/2016 | Karkow et al. |
| 9,388,981 | B2 | 7/2016 | Karkow et al. |
| 9,447,965 | B2 | 9/2016 | Karkow et al. |
| 9,562,682 | B2 | 2/2017 | Karkow et al. |
| 2006/0141413 | A1 | 6/2006 | Masten et al. |
| 2011/0076628 | A1 | 3/2011 | Miura et al. |
| 2012/0164590 | A1 | 6/2012 | Mach |
| 2012/0231398 | A1 | 9/2012 | Carpentier et al. |
| 2015/0118629 | A1 | 4/2015 | Colannino et al. |
| 2015/0276217 | A1 | 10/2015 | Karkow et al. |
| 2015/0316261 | A1 | 11/2015 | Karkow et al. |
| 2015/0330625 | A1 | 11/2015 | Karkow et al. |
| 2015/0362177 | A1 | 12/2015 | Krichtafovitch et al. |
| 2015/0362178 | A1 | 12/2015 | Karkow et al. |
| 2015/0369477 | A1 | 12/2015 | Karkow et al. |
| 2016/0003471 | A1 | 1/2016 | Karkow et al. |
| 2016/0018103 | A1 | 1/2016 | Karkow et al. |
| 2016/0025374 | A1 | 1/2016 | Karkow et al. |
| 2016/0025380 | A1 | 1/2016 | Karkow et al. |
| 2016/0046524 | A1 | 2/2016 | Colannino et al. |
| 2016/0091200 | A1 | 3/2016 | Colannino et al. |
| 2016/0230984 | A1 | 8/2016 | Colannino et al. |
| 2016/0238240 | A1 | 8/2016 | Colannino et al. |
| 2016/0238242 | A1 | 8/2016 | Karkow et al. |
| 2016/0238277 | A1 | 8/2016 | Colannino et al. |
| 2016/0238318 | A1 | 8/2016 | Colannino et al. |
| 2016/0245509 | A1 | 8/2016 | Karkow et al. |
| 2016/0276212 | A1 | 10/2016 | Rutkowski et al. |
| 2016/0290639 | A1 | 10/2016 | Karkow et al. |
| 2016/0298838 | A1 | 10/2016 | Karkow et al. |
| 2016/0298840 | A1 | 10/2016 | Karkow et al. |
| 2016/0305660 | A1 | 10/2016 | Colannino et al. |
| 2016/0348899 | A1 | 12/2016 | Karkow et al. |
| 2016/0348900 | A1 | 12/2016 | Colannino et al. |
| 2016/0348901 | A1 | 12/2016 | Karkow et al. |
| 2017/0010019 | A1 | 1/2017 | Karkow et al. |
| 2017/0038063 | A1 | 2/2017 | Colannino et al. |
| 2017/0038064 | A1 | 2/2017 | Colannino et al. |
| 2017/0051913 | A1 | 2/2017 | Colannino et al. |

FOREIGN PATENT DOCUMENTS

| | | |
|---|---|---|
| WO | WO 1993/018342 | 9/1993 |
| WO | 2014/127307 | 8/2014 |
| WO | WO 2015/112950 | 7/2015 |
| WO | WO 2015/123149 | 8/2015 |
| WO | WO 2015/123683 | 8/2015 |
| WO | WO 2016/105489 | 6/2016 |
| WO | WO 2016/133934 | 8/2016 |
| WO | WO 2016/133936 | 8/2016 |
| WO | WO 2016/134061 | 8/2016 |
| WO | WO 2016/134068 | 8/2016 |
| WO | WO 2016/134180 | 8/2016 |
| WO | WO 2016/141362 | 9/2016 |
| WO | WO 2017/048638 | 3/2017 |

MULTI-NOZZLE COMBUSTION ASSEMBLIES INCLUDING PERFORATED FLAME HOLDER, COMBUSTION SYSTEMS INCLUDING THE COMBUSTION ASSEMBLIES, AND RELATED METHODS

CROSS-REFERENCE TO RELATED APPLICATIONS

This application claims priority to U.S. Provisional Application No. 62/310,433 filed on 18 Mar. 2016, the disclosure of which is incorporated herein, in its entirety, by this reference.

BACKGROUND

There are many different types of burners and combustion systems. Generally, a burner or combustion system includes a fuel nozzle that injects fuel into a combustion chamber. The fuel mixes with an oxidant (e.g., air) and, after mixing, the fuel and air mixture is ignited and combusted in the combustion chamber to generate heat. Furthermore, heat generated by the combustion system may be transferred and may raise a temperature of one or more objects and/or materials. For example, heat may be transferred from the combustion system to one or more pipes in a boiler system.

One or more pollutants may be produced during combustion of the fuel. Typically, such pollutants are exhausted into an outside environment and/or atmosphere and may have a negative impact on that environment. In addition, typical combustion systems operate below a theoretical maximum efficiency for converting chemical energy of the fuel into heat, which may be transferred to one or more objects or materials that are heated by the combustion system.

Therefore, developers and users of burners and combustion systems continue to seek improvements to operating efficiency thereof and/or production of pollutants thereby.

SUMMARY

Embodiments disclosed herein are directed to integrated combustion assemblies including a perforated flame holder, combustion systems that include one or more integrated combustion assemblies, and related methods of making and using the same. For example, an integrated combustion assembly may be placed into service (e.g., integrated into a combustion system) as a complete and/or replaceable unit such that elements and/or components of the combustion assembly are preassembled and no further assembly is required at the installation site. In some configurations, an existing combustion system may be retrofitted with one or more combustion assemblies, which may be swapped in and/or exchanged for existing burners, without requiring further assembly and/or modifications during the retrofitting, which may reduce installation errors and/or improve quality of the retrofitted assembly (e.g., as compared with a retrofit that requires assembly of multiple components at the retrofit site).

In an embodiment, an integrated combustion assembly is disclosed. The integrated combustion assembly includes one or more fuel nozzles each of which is configured to output fuel flow in generally a downstream direction, and a fuel distribution hub operably coupled to the plurality of fuel nozzles and configured to distribute fuel among the plurality of fuel nozzles. The integrated combustion assembly further includes a perforated flame holder including a body defining a plurality of apertures that extend between an upstream side of the perforated flame holder and a downstream side of the perforated flame holder. The perforated flame holder is positioned at a selected distance downstream from the plurality of fuel nozzles and defining a flow space between the upstream side of the flame holder and the plurality of fuel nozzles. One or more supports extend downstream from the plurality of fuel nozzles and support the perforated flame holder at the selected distance from the plurality of fuel nozzles.

In an embodiment, a heating unit is disclosed. The heating unit includes a shell defining an interior space of the heating unit, and one or more integrated combustion assemblies extending into the interior space. Each of the one or more integrated combustion assemblies includes a plurality of fuel nozzles each of which is configured to output fuel flow in generally a downstream direction, a fuel distribution hub operably coupled to the plurality of fuel nozzles and configured to distribute fuel among the plurality of fuel nozzles, and a perforated flame holder positioned at a selected distance downstream from the plurality of fuel nozzles and defining a flow space between an upstream side of the perforated flame holder and the plurality of fuel nozzles. The perforated flame holder includes a body defining a plurality of apertures that extend between the upstream side of the perforated flame holder and a downstream side of the perforated flame holder. Each of the one or more integrated combustion assemblies further includes one or more supports extending downstream from the plurality of fuel nozzles and supporting the flame holder at the selected distance from the plurality of fuel nozzles.

In an embodiment, a method of upgrading a heating unit is disclosed. At least one burner is removed from the heating unit, thereby vacating a burner space therein. An integrated combustion assembly is installed in the vacated burner space in the heating unit. The integrated combustion assembly includes a fuel distribution hub operably coupled to the plurality of fuel nozzles and configured to distribute fuel among a plurality of fuel nozzles, a perforated flame holder positioned at a selected distance downstream from the plurality of fuel nozzles and defining a flow space between a downstream side of the perforated flame holder and the plurality of fuel nozzles, and one or more supports extending downstream from the plurality of fuel nozzles and supporting the perforated flame holder at the selected distance from the plurality of fuel nozzles. The perforated flame holder includes a body defining a plurality of apertures that extend between an upstream side of the perforated flame holder and the downstream side of the perforated flame holder. Each of the plurality of fuel nozzles is configured to output fuel flow in generally a downstream direction.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments, wherein identical reference numerals refer to identical or similar elements or features in different views or embodiments shown in the drawings.

DETAILED DESCRIPTION

Figure 1:
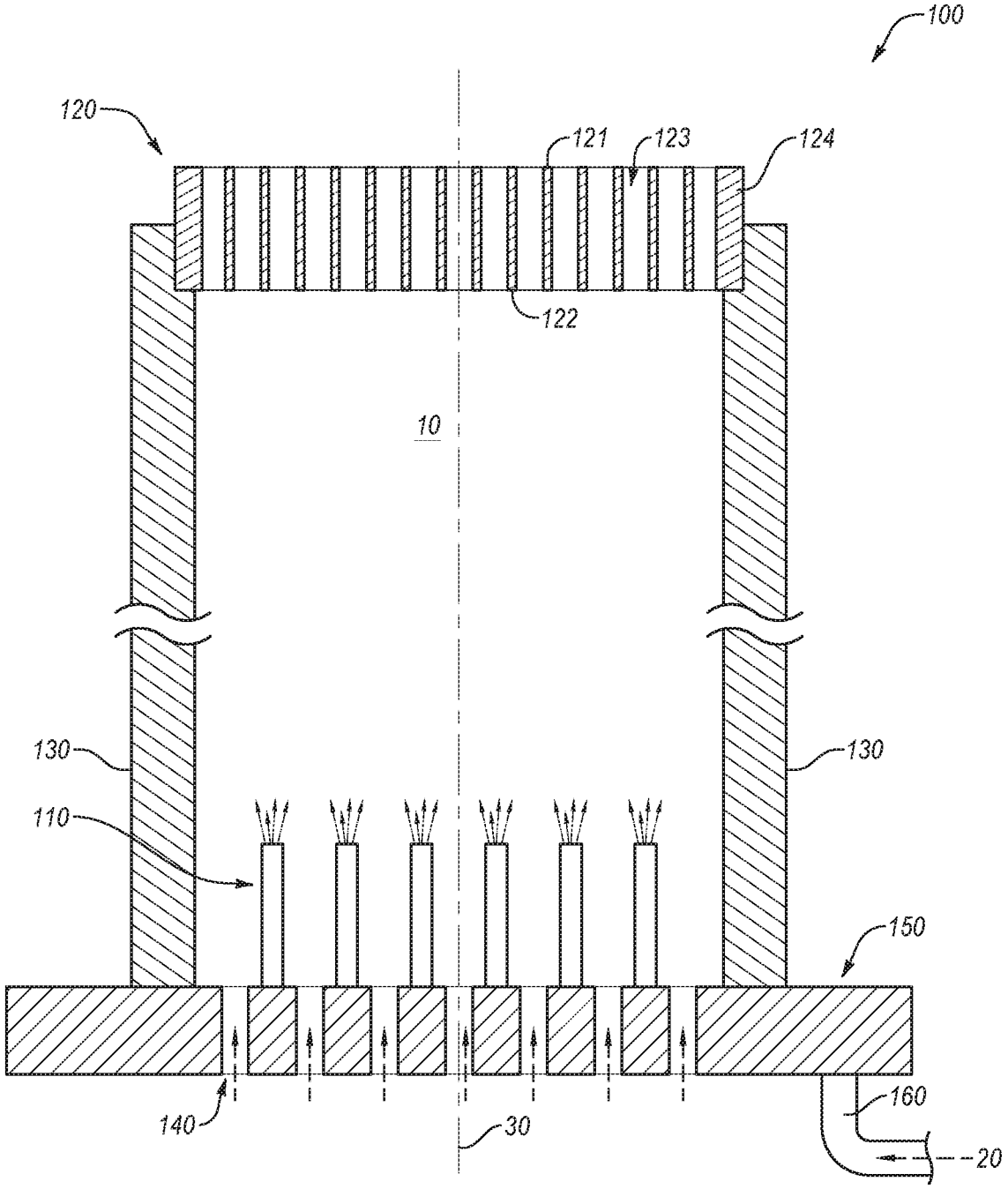
FIG. 1 is a cross-sectional view of an integrated combustion assembly, according to an embodiment.

Embodiments disclosed herein are directed to integrated combustion assemblies including a perforated flame holder, combustion systems that include one or more integrated combustion assemblies, and related methods of making and using the same. For example, an integrated combustion assembly may be placed into service (e.g., integrated into a combustion system) as a complete and/or replaceable unit, such that elements and/or components of the combustion assembly are preassembled and no further assembly is required at the installation site. In some configurations, an existing combustion system may be retrofitted with one or more combustion assemblies, which may be swapped in and/or exchanged for existing burners, without requiring further assembly and/or modifications during the retrofitting, which may reduce installation errors and/or improve quality of the retrofitted assembly (e.g., as compared with a retrofit that requires assembly of multiple components at the retrofit site).

In an embodiment, an integrated combustion assembly may include multiple fuel nozzles secured by and/or connected to a fuel distribution hub and may include a perforated flame holder that may be positioned at a selected distance downstream from the fuel nozzles. For example, the integrated combustion assembly may include one or more supports that may secure the flame holder at the selected distance downstream from the fuel nozzles (e.g., the support(s) may be secured or connected to the fuel distribution hub and may extend downstream therefrom, and the flame holder may be positioned on and/or secured to the support(s)). The support(s) may be formed from a heat-resistant material, such as a nickel superalloy, a stainless steel (e.g., RA 253 MA® or other suitable creep resistant stainless steel), ceramic, such as silicon carbide, or other suitable material (e.g., refractory materials). In at least one embodiment, the flame holder includes a plate or a body having one or more apertures extending therethrough in a direction of fuel flow from the fuel nozzles. Under some operating conditions, fuel flowing from the fuel nozzles and an oxidant may enter at least some of the apertures in a manner that the apertures facilitate mixing of the fuel and oxidant therein (e.g., to improve combustion of the fuel).

Generally, the fuel nozzles may be arranged in any number of suitable arrangements. For example, the fuel nozzles may be arranged along one or more generally circular paths. Likewise, the flame holder may have any number of apertures extending through the body thereof, and the apertures may be arranged in any number of suitable arrangements and/or may have any number of suitable sizes. For example, the apertures may be arranged along one or more generally circular paths or a rectilinear array.

In some embodiments, the combustion system may exhibit an increased or improved heat transfer therefrom to one or more objects and/or material heated thereby. As such, under some operating conditions, a greater amount of chemical energy stored in a fuel may be converted to heat transferred to objects and/or materials heated by the retrofitted heating unit or combustion system (e.g., more of the chemical energy may be converted to radiant heat that may be transferred more efficiently to one or more materials heated thereby than by, for example, convection). Furthermore, the combustion system may combust the fuel at a lower temperature than a conventional combustion system. Under some operating conditions, by reducing the combustion temperature, an amount of pollutants produced by the retrofitted combustion system also may be reduced (e.g., as compared to the amount of pollutants produced by a conventional combustion system). For example, the combustion system may produce less oxides of nitrogen "$NO_x$" (e.g., NO and/or $NO_2$) than a conventional combustion system. In some embodiments, the combustion system may facilitate a leaner combustion than a conventional combustion system (e.g., the combustion system may sustain a flame from a leaner fuel to air ratio than may be sustained by the conventional combustion system).

FIG. 1 is a cross-sectional view of an integrated combustion assembly 100, according to an embodiment, which may be included in and/or retrofitted into a combustion system. In the illustrated embodiment, the integrated combustion assembly 100 includes multiple nozzles fuel nozzles 110 extending into a flow space 10 of the integrated combustion assembly 100. Moreover, the integrated combustion assembly 100 includes a perforated flame holder 120 positioned downstream of fuel flow from the fuel nozzles 110. For example, supports 130 extending downstream from the fuel nozzles 110 may position the flame holder 120 at a selected distance downstream from the fuel nozzles 110. The integrated combustion assembly 100 also may include one or more oxidant inlets 140 to facilitate flow of oxidant into the flow space 10, such as air or other suitable oxidant.

The flame holder 120 may be attached to and/or positioned on the supports 130 with any number of suitable mechanisms and in any number of suitable configurations. In an embodiment, the supports 130 may include a shoulder, which may position and/or orient the flame holder 120 relative to the fuel nozzles 110 (e.g., an downstream side 121 of the flame holder 120 may be positioned at a selected distance from the fuel nozzles 110). Additionally or alternatively, the flame holder 120 may be fastened, brazed, welded, or otherwise secured to the supports 130 and/or via an intermediate support structure (e.g., a flame holder support system or structure that may be secured to the supports 130) in another suitable manner. In some embodiments, the flame holder 120 may be positioned on an intermediate support structure without being fastened thereto. In an embodiment, an annular refractory tile (not shown) may extend circumferentially about the fuel nozzles 110 and inside the flow space 10.

Generally, the fuel nozzles 110 may inject fuel into the flow space 10 and the oxidant inlets 140 may facilitate flow of and/or force oxidant into the flow space 10. For example, the fuel may include a hydrocarbon gas such as natural gas (mostly $CH_4$) or propane, or hydrocarbon liquids such as fuel oil, diesel oil, etc. Additionally or alternatively, other suitable fuels include hydrogen or mixtures of gaseous fuels such as methane, carbon monoxide, and hydrogen. The fuel and oxidant may mix (e.g., in the flow space 10 and/or in apertures 123 of the flame holder 120 (described below in more detail), etc.) and may be ignited and combusted thereafter. For example, the integrated combustion assembly 100 may include an ignition device, such as a spark igniter, which may be positioned downstream of the fuel and air flow and may ignite the fuel. Ignition and/or combustion of the fuel and oxidant in the flow space 10 may produce a flame that, in some embodiments, may be anchored at, in, and/or near the flame holder 120.

The flame holder 120 may have downstream side 121 and upstream side 122. As the fuel and air mixture approaches and/or contacts the flame holder 120 (e.g., the upstream side 122 of the flame holder 120), the fuel and air mixture may be ignited and/or combusted. Furthermore, the flame holder 120 includes a plurality of apertures 123 that may be formed in and/or defined by a body 124 of the flame holder 120. Each or some of the apertures 123 extend from the downstream side 121 to the upstream side 122 and completely through the body 124. In any event, as the fuel and air mixture ignites and/or combusts at, in, and/or near the flame holder 120, at least some of the flame formed thereby may enter and/or be formed in and/or near one or more of the apertures 123 in the body 124 of the flame holder 120.

Generally, the flame holder 120 may be formed from and/or include any number of suitable materials, which may vary from one embodiment to the next. For example, the flame holder 120 may include refractory metal materials, ceramics, high-temperature alloys (e.g., nickel superalloys), etc. The apertures 123 of the flame holder 120 may have any suitable shape and/or size (e.g., the apertures 123 may be approximately cylindrical, prismoid, etc.). Similarly, the apertures 123 may be positioned and/or arranged on the body 124 in any number of suitable configurations (e.g., the apertures 123 may have a generally circular arrangement on the body 124 of the flame holder 120). Examples of suitable configurations for the flame holder 120 are disclosed in PCT International Application No. PCT/US2014/016628 filed on 14 Feb. 2014, the disclosure of which is incorporated herein in its entirety by this reference.

The flame holder 120 also may have any suitable thickness, shape, size, or combinations thereof. In at least one embodiment, the flame holder 120 may have an approximately cylindrical shape (e.g., the flame holder 120 may have a rectangular cross-section). Moreover, in some embodiments, the thickness of the flame holder 120 may be selected such that the combusted fuel produces a flame located at or near the upstream side 122, the downstream side 121 of the flame holder 122, in the flame holder 122 itself, or combinations thereof.

As mentioned above, the integrated combustion assembly 100 may include a fuel distribution hub 150 operably coupled to one, some, or all of the fuel nozzles 110 and configured to distribute fuel 20 to and/or among the fuel nozzles 110. In an embodiment, the fuel nozzles 110 may be connected to the fuel distribution hub 150 such that fuel 20 flowing from a fuel supply line 160 may enter the fuel distribution hub 150 and may be distributed to the fuel nozzles 110 (e.g., through one or more channels in the fuel distribution hub 150 that are in fluid communication with corresponding ones of the fuel nozzles 110). For example, the fuel 20 may be generally evenly or generally equally distributed among the fuel nozzles 110 by the fuel distribution hub 150. Alternatively, more of the fuel may be preferentially distributed to one or more of the fuel nozzles 110 than one or more other fuel nozzles 110. For example, the fuel nozzles 110 positioned farther from a general fuel flow line or centerline 30 of the flow space 10 and/or of the integrated combustion assembly 100 may receive more fuel than the fuel nozzles 110 closer to the centerline 30, or vice versa).

The fuel from the fuel nozzles 110 may be generally injected or may flow into the flow space 10. In some embodiments, the distribution of the fuel in the flow space 10 may be at least partially controlled or regulated by the fuel distribution hub 150. Additionally or alternatively, as described below in more detail, the direction and/or that amount of fuel injected into the flow space 10 may be at least partially controlled and regulated by nozzle orientations and/or sizes of the corresponding fuel nozzles 110. In any event, the fuel 20 may enter the fuel distribution hub 150 from the fuel supply line 160, may be distributed to the fuel nozzles 110 in any number of suitable ways and/or quantities, and may flow from the fuel nozzles 110 into the flow space 10.

Figure 2:
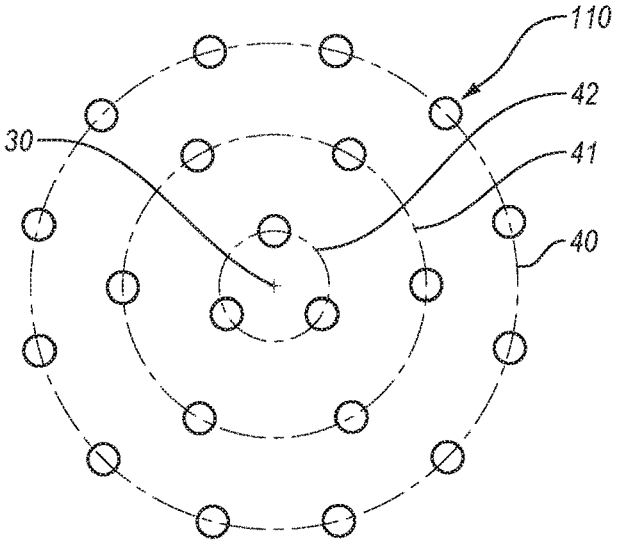
FIG. 2 is a schematic diagram of a fuel nozzle arrangement, according to an embodiment.

As described above, the fuel nozzles 110 may be positioned in any number of suitable arrangements. FIG. 2 shows an arrangement of the fuel nozzles 110, according to an embodiment. In particular, in some embodiments, the fuel nozzles 110 may be arranged along multiple paths, such as circular paths 40, 41, 42. In at least one embodiment, the paths 40, 41, 42 may be generally concentric (e.g., the paths 40, 41, 42 may be concentric with one another and/or may be centered about the centerline 30 of the integrated combustion assembly and/or of the flow space).

In some embodiments, in one, some, or each of the paths 40, 41, 42, the adjacent fuel nozzles 110 may be spaced from one another at substantially the same distances, as measured along the corresponding paths 40, 41, 42. Hence, for example, there may be more fuel nozzles 110 positioned along paths having a greater diameter than along paths having a smaller diameter (e.g., there may be more fuel nozzles 110 positioned along the path 40 than along the path 41). Alternatively, at least some of the adjacent fuel nozzles 110 may have different distances or spacing.

In the illustrated embodiment, outer paths (e.g., the paths having a relatively greater diameter) have more of the fuel nozzles 110 positioned thereon than inner paths (e.g., the path having a relatively smaller diameter). More specifically, the path 40 has more of the fuel nozzles 110 positioned thereon than the path 41, and the path 41 has more of the fuel nozzles 110 positioned thereon than the path 42. In particular, for example, the number of the fuel nozzles 110 positioned on each subsequent outer path may be greater than the number of the fuel nozzles 110 positioned on the preceding inner path by a select ratio (e.g., an integer-based ration, such as 2×, 3×, etc.). In the illustrated embodiment, each subsequent outer path has twice as many of the fuel nozzles 110 positioned thereon than the immediately preceding inner path (e.g., the path 42 has three fuel nozzles 110 positioned thereon, the path 41 has six fuel nozzles 110 positioned thereon, and the path 40 has twelve fuel nozzles 110 positioned thereon). However, the number and distribution of the fuel nozzles 110 may depart from the illustrated embodiment.

In some embodiments, the circular paths 40, 41, 42 may be substantially equidistantly spaced from the adjacent ones of the paths 40, 41, 42 (e.g., the difference between radii of the path 40 and path 41 may be approximately the same as the difference between the radii of the paths 41 and 42). It should be appreciated, however, that the paths may have any suitable shape and the fuel nozzles 110 may be arranged thereon in any number of suitable arrangements. Also, the paths may have any suitable spacing therebetween. Moreover, the fuel nozzles 110 may be arranged in any number of arrangements that do not follow any path or that have irregular-shaped paths.

Figure 3:
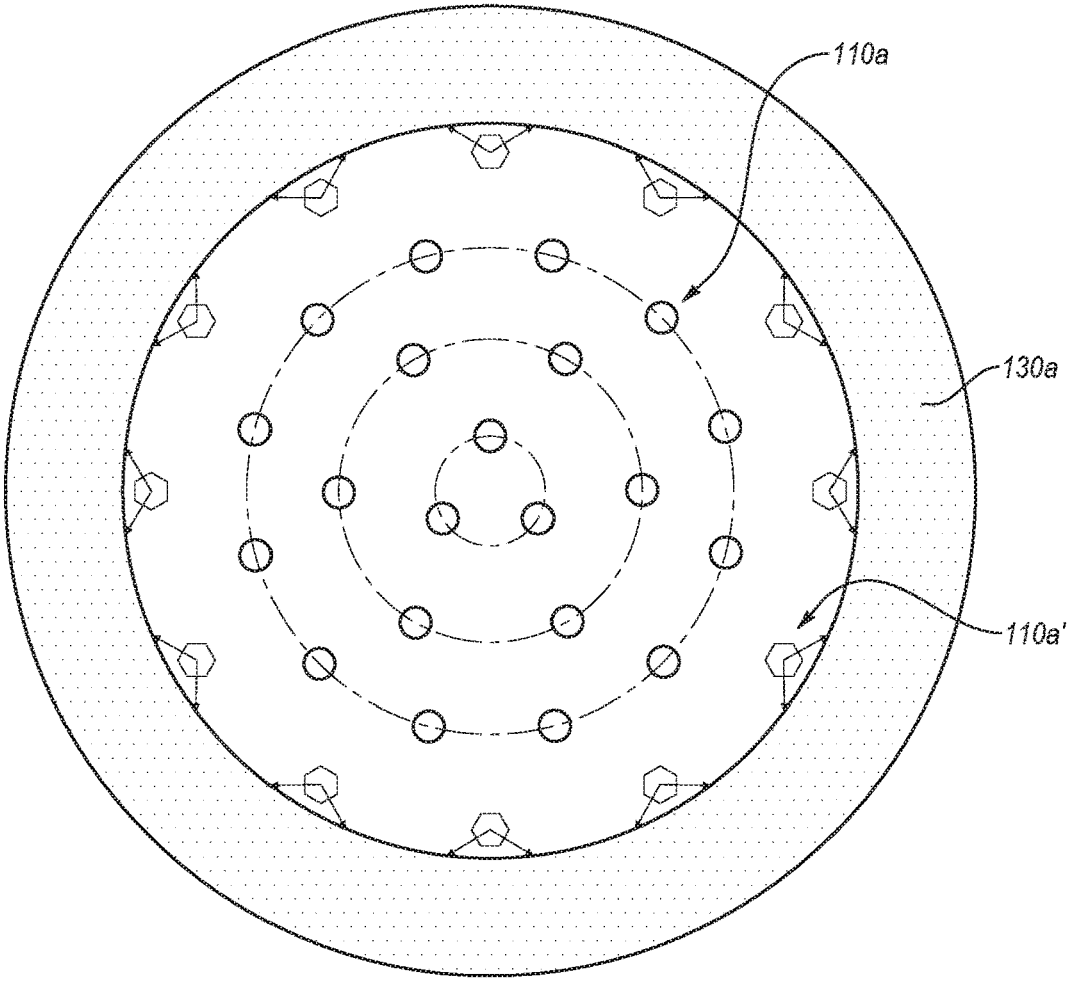
FIG. 3 is a top view of a fuel nozzle arrangement, according to another embodiment.

FIG. 3 is a top view of an arrangement of fuel nozzles 110*a* and fuel nozzles 110*a*', according to an embodiment. For example, the fuel nozzles 110*a* may be arranged in a similar manner as the fuel nozzles 110 (as described above in connection with FIG. 2). As described above, an integrated combustion assembly may include one or more supports. For example, the integrated combustion assembly may include a single generally tubular support, such as support 130*a*. However, in other embodiments, the element 130*a* may constitute an annular refractory tile and the support structure may extend about the annular refractory tile to support a perforated flame holder. In an embodiment, the support 130*a* may be preheated to promote combustion and/or placement of the flame at or near the flame holder. For example, one or more fuel nozzles 110*a*' may be positioned radially near the support 130*a* and/or in a manner that the flame produced by combustion of fuel exiting the fuel nozzles 110*a* heats the support 130*a*, such as a portion of the support 130*a* near the flame holder (e.g., the heated portion of the support 130*a* may ignite and/or at least in part support combustion of fuel 20 at or near the flame holder). As described below in more detail, respective orifices of the fuel nozzles 110*a*' may be angled and/or configured in a manner that at least a portion of the fuel flowing therefrom and into the flow space flows along and/or near an inner vertical surface of the support 130*a* (e.g., radially near the support 130*a* and out of plane show in FIG. 3).

Figure 4:
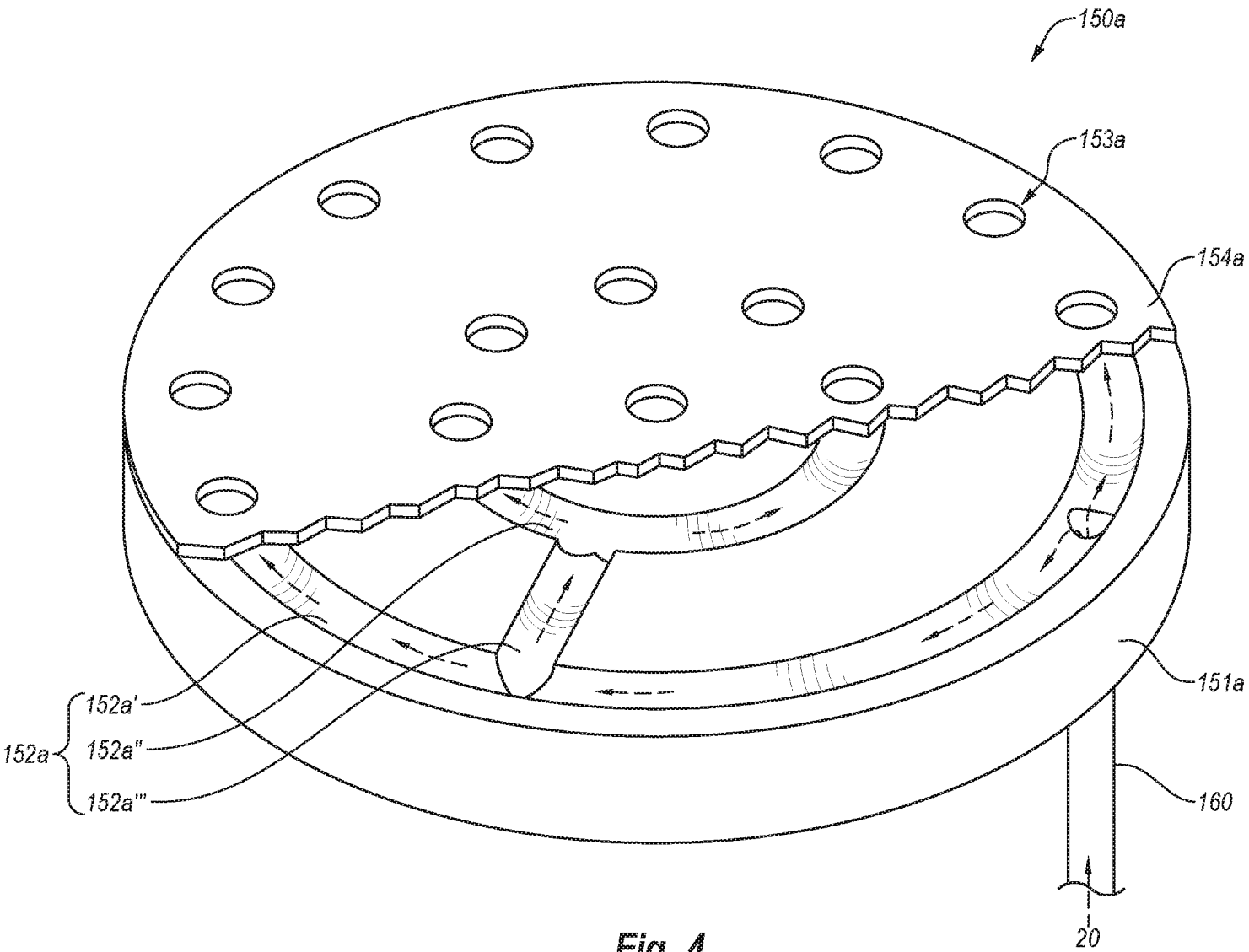
FIG. 4 is an isometric cutaway view of a fuel distribution hub, according to an embodiment.

Generally, the fuel nozzles (e.g., the fuel nozzles 110*a* and/or fuel nozzles 110*a*') may be independently connected to a fuel supply or may be connected to a common fuel distribution hub that connects to a fuel supply and distributes and/or regulates distribution of fuel 20 among the fuel nozzles. FIG. 4 illustrates a fuel distribution hub 150*a* according to an embodiment, which may be employed in any of the embodiments disclosed herein. For example, the fuel distribution hub 150*a* may include a hub body 151*a* and one or more fuel channels extending or formed therein (e.g., fuel channels 152*a*, such as fuel channels 152*a*', 152*a*", 152*a*'").

Generally, the fuel channels 152*a* may have any suitable shape (e.g., cross-sectional shape and/or extended shape), length, arrangement, and combinations of the foregoing, which may vary from one embodiment to the next. In the illustrated embodiment, at least some of the fuel channels 152*a* extend in generally circular or radial paths. For example, the fuel channel 152*a*' and the fuel channel 152*a*" may extend about the same or similar circular paths as corresponding fuel nozzles (e.g., the centerlines of the fuel channel 152*a*' and the fuel channel 152*a*" may be located on or correspond to generally circular paths). Alternatively or additionally, the fuel channels 152*a* may extend in the hub body 151*a* along any number of paths, such as to connect the fuel nozzles to the fuel 20 flowing in fuel channels 152*a*.

Moreover, the fuel distribution hub 150*a* may include channels that extend radially (e.g., fuel channels 152*a*'") and/or connect adjacent radial or circular channels, such as fuel channels 152*a*', 152*a*". As mentioned above, the fuel channels 152*a* may have any suitable cross-sectional shape (e.g., half-round, square, rectangular, etc.) and/or size (e.g., cross-sectional area). Furthermore, the shape and/or size of the fuel channels 152*a* may vary from one to another. For example, reducing or increasing size of one or more fuel channels 152*a* as compared to another fuel channels 152*a* may control flow of fuel 20 to one or more fuel nozzles by correspondingly increasing or decreasing flow of fuel 20 in the fuel channels 152*a* that supply the fuel to such nozzles.

Alternatively or additionally, one, some, or each of the fuel nozzles may be connected to an independent channel and/or fuel line. For example, each of the fuel nozzles may connect to a designated fuel line that may supply a suitable amount of fuel thereto. Moreover, in some embodiments, fuel flow from each of the designated or corresponding fuel lines may be controlled by a corresponding valve (e.g., mechanical or electromechanical valve), such that, for example, the fuel flow to any of the nozzles may be controlled independently of all other nozzles.

In an embodiment, the fuel distribution hub 150*a* includes openings 153*a* that correspond to and place the corresponding fuel nozzles in fluid communication with the fuel channels 152*a*, such that fuel 20 may be supplied from the fuel distribution hub 150*a* into the fuel nozzles. In some embodiments, the fuel distribution hub 150*a* may include a cover 154*a*, which may seal the fuel 20 in the fuel channels 152*a*, such that the fuel 20 may flow along the fuel channels 152*a* without leaking out of the fuel distribution hub 150*a*. The openings 153*a* may extend through the cover 154*a* and to the fuel channels 152*a*, such that the fuel flowing in the fuel channels 152*a* may exit through the openings 153*a* and enter the fuel nozzles. In at least one embodiment, the fuel nozzles may seal against the fuel distribution hub 150*a* (e.g., inside corresponding openings 153*a*, against the cover 154*a* and about the corresponding openings 153*a*, combinations thereof, etc.), such as to prevent or limit fuel leaks between the fuel distribution hub 150*a* and the fuel nozzles. In any event, the fuel distribution hub 150*a* may distribute and/or regulate distribution of fuel 20 to corresponding fuel nozzles of the integrated combustion assembly.

In at least one embodiment, the distribution hub may have fewer or no fuel channels, such that fuel is distributed to two or more fuel nozzles at substantially the same pressure. For example, the distribution hub may have a generally hollow interior (defined by exterior walls of the distribution hub), and the fuel may flow from a fuel supply (e.g., from a fuel supply line) into the interior and subsequently to the openings in the distribution hub, which supply the fuel to the fuel nozzles. In an embodiment, a pilot nozzle may be supplied directly (e.g., a fuel supply to the pilot nozzle may be from a separate channel and/or may pass through the distribution hub and connect to the pilot nozzle that, for example, may be positioned approximately at the center of the integrated combustion assembly).

In any event, the fuel 20 may be distributed in a suitable or selected amounts to suitable and/or selected fuel nozzles in the integrated combustion assembly and may exit or flow out of the fuel nozzles into the flow space thereof. In some embodiments, one or more of the fuel nozzles in the integrated combustion assembly may flow at least some fuel in a direction generally parallel to the centerline of the integrated combustion assembly. FIG. 5A shows a partial, cross-sectional view of an integrated combustion assembly

Figure 5B:
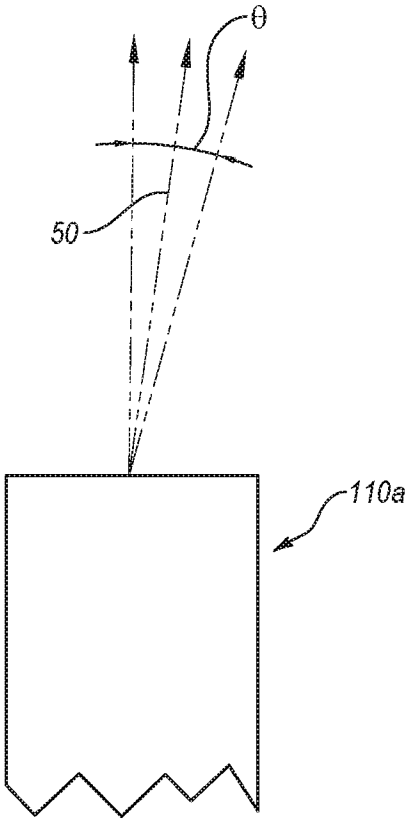
FIG. 5B is an enlarged, partial side view of one of the fuel nozzles as shown in FIG. 5A.
Figure 5A:
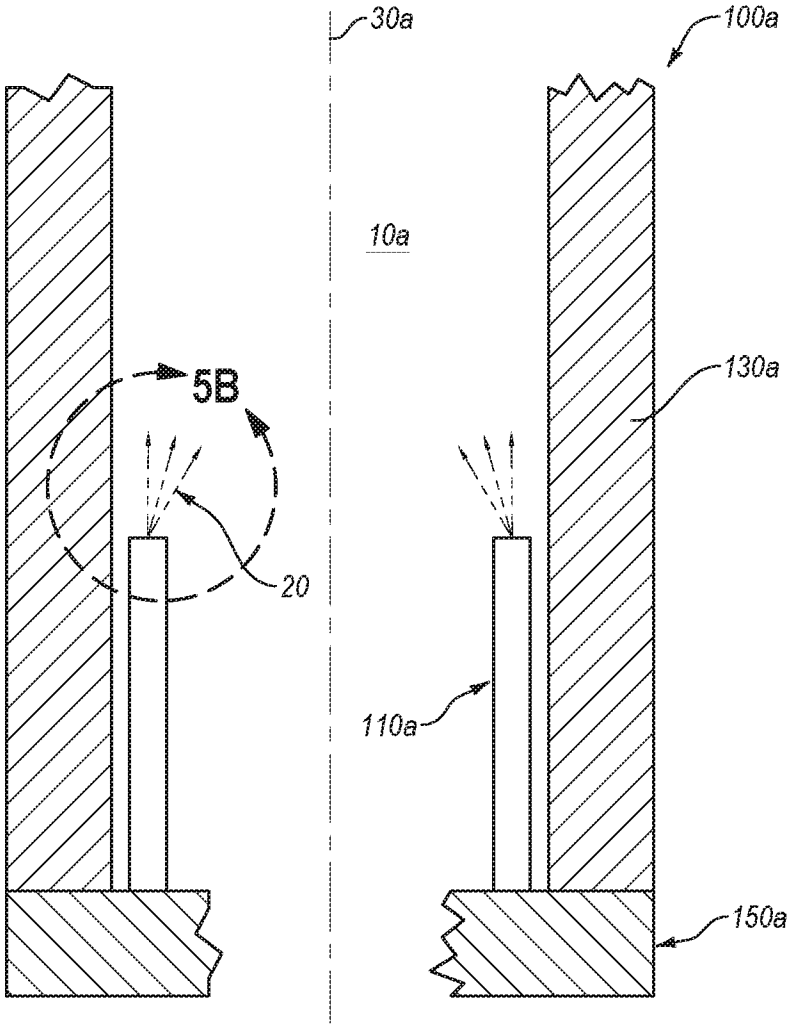
FIG. 5A is a partial cross-sectional view of an integrated combustion assembly, according to an embodiment.

100*a* that includes fuel nozzles 110*a* that flow fuel into 10*a*, and FIG. 5B is an enlarged, partial side view of a portion of one of the fuel nozzles 110*a*, according to an embodiment. Except as otherwise described herein, the integrated combustion assembly 100*a* and its elements and components may be similar to or the same as the integrated combustion assembly 100 (FIG. 1) and its corresponding elements and components. For example, the integrated combustion assembly 100*a* may include a fuel distribution hub 150*a* that secures the fuel nozzles 110*a* and distributes fuel thereto, which may be similar to the fuel distribution hub 150 and/or fuel nozzles 110 of the integrated combustion assembly 100 (FIG. 1). Additionally or alternatively, the integrated combustion assembly 100*a* may include support 130*a* that may secure the fuel distribution hub 150*a* and/or a flame holder (not shown) that may be positioned downstream from the fuel nozzles 110*a*.

In an embodiment, the fuel nozzles 110*a* may flow fuel 20 into flow space 10*a* of the integrated combustion assembly 100*a*. The fuel 20 may exit the fuel nozzles 110*a* as a spray or flow that may have any suitable shape. For example, after exiting the fuel nozzles 110*a*, the fuel 20 may form a flow having a generally conical shape, a fan shape, etc. (e.g., the fan, cone, etc., formed by the flow of the fuel 20 may have a spray angle θ (FIG. 5B) that may be any suitable angle, such as 5°, 10°, 15°, etc.). In some embodiments, at least a portion of the fuel 20 exiting the fuel nozzles 110*a* may flow generally parallel to centerline 30*a* of the integrated combustion assembly 100*a*. Additionally or alternatively, at least a portion of the fuel 20 exiting the fuel nozzles 110*a* may flow generally parallel to one or more walls and/or portions of the support 130*a*.

In an embodiment, at least some of the fuel nozzles 110*a* that are located near and/or closest to the interior surface of the support 130*a* or a burner tile (not shown) may flow at least a portion of the fuel 20 substantially parallel to the interior surface of the support 130*a* and/or the burner tile. For example, spray angle bisector 50 (FIG. 5B) may be oriented at a non-parallel angle relative to centerline 30*a* of the integrated combustion assembly 100*a*. Hence, under some operating conditions, the integrated combustion assembly 100*a* may have less fuel 20 present at the periphery of the flow space 10*a* and/or near the interior surface of the support 130*a* (e.g., as compared to a combustion assembly that has fuel nozzles that flow fuel at a spray angle where the spray angle bisector is generally parallel to the centerline of the combustion assembly). For example, more fuel may be distributed to one or more locations near the flame holder.

Figure 6:
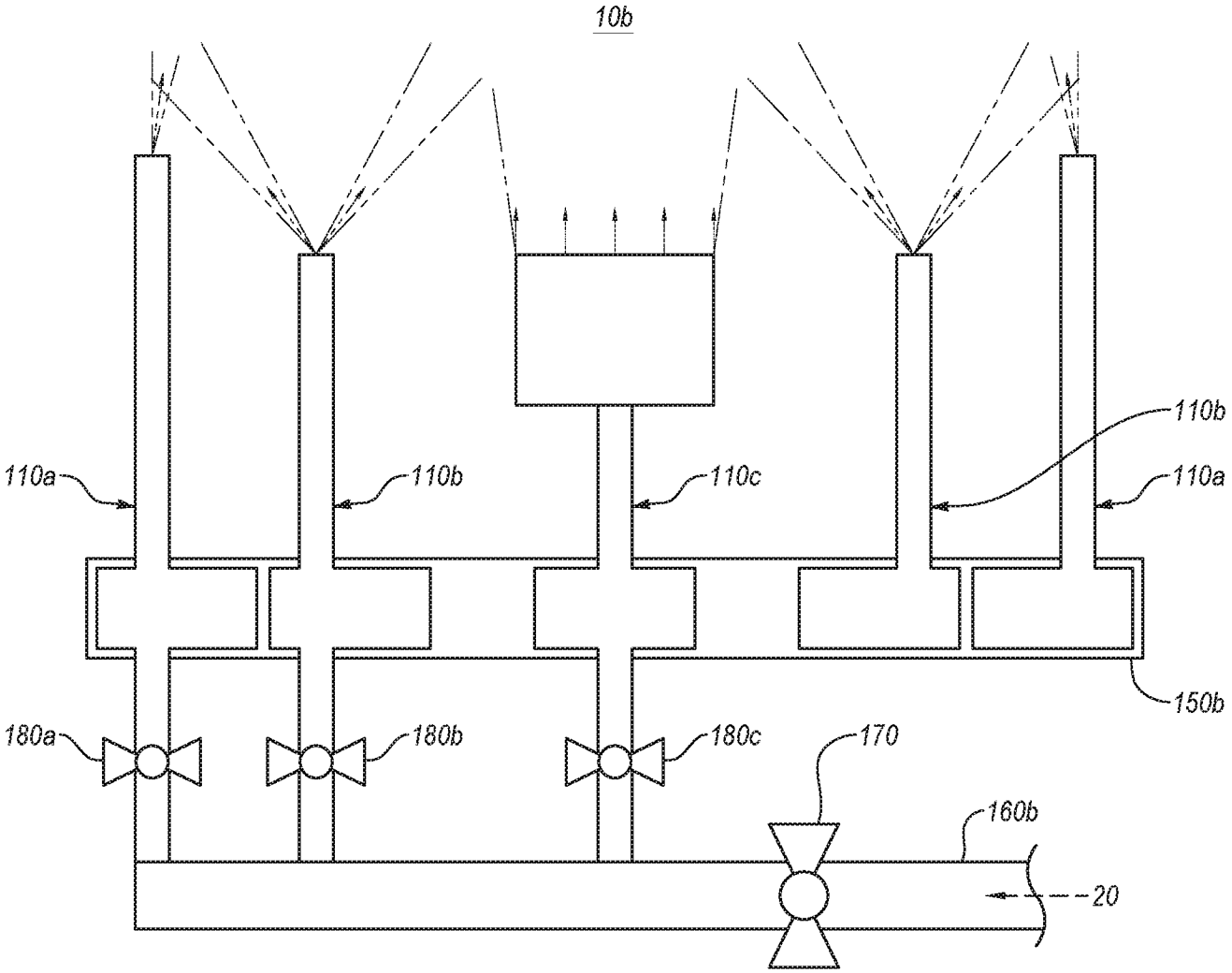
FIG. 6 is a schematic diagram of fuel nozzles connected to a fuel distribution hub, according to an embodiment.

Moreover, fuel nozzles of the integrated combustion assembly may have any number of suitable spray angles, which may vary from one fuel nozzle to another and/or from one embodiment to another. FIG. 6 is a schematic illustration of a nozzle arrangement, according to an embodiment. In particular, in the illustrated embodiment, fuel nozzles 110*a*, 110*b*, 110*c* may be secured to a fuel distribution hub 150*b* that may distribute fuel 20 to the fuel nozzles 110*a*, 110*b*, 110*c*. In particular, fuel supply line 160*b* may connect a fuel source to the fuel distribution hub 150*b* and may supply fuel 20 thereto and to the fuel nozzles 110*a*, 110*b*, 110*c*. For example, a main valve 170 may control flow of fuel 20 in the fuel supply line 160*b* and toward the fuel nozzles 110*a*, 110*b*, 110*c* (e.g., the fuel 20 may flow from the fuel supply line 160*b* into the fuel distribution hub 150*b* and may be distributed thereby to the fuel nozzles 110*a*, 110*b*, 110*c*).

The fuel nozzles 110*a*, 110*b*, 110*c* may have any number of suitable sizes (e.g., heights, widths, etc.), flow throughputs, spray angles, orientations, combinations of the foregoing, etc., which may vary from one fuel nozzle to another and/or from one embodiment to another. In some embodiments, the fuel nozzles 110*a*, 110*b*, 110*c* may supply the fuel 20 into the flow space 10*b* in a manner that produces a generally uniform or balanced distribution of the fuel 20 and/or of the fuel-oxidant mixture inside the flow space 10*b*. For example, as shown in FIG. 6, the fuel nozzles 110*a*, 110*b*, 110*c* may flow fuel 20 into the flow space 10*b* at various spray angles, spray volumes, and spray angle orientations, such as to balance the amount of fuel 20 and/or of the fuel-oxidant mixture inside the flow space 10*b*.

In an embodiment, the fuel nozzles 110*a* may flow at least some of the fuel 20 in a direction that may be generally parallel to the centerline of the combustion assembly and/or to the orientation of the fuel nozzles 110*a*. For example, at least some of the fuel 20 that may flow near and/or close to an interior wall that may define the flow space 10*b* may flow generally parallel to such wall and/or to the centerline of the combustion assembly. In some embodiments, the fuel nozzles 110*a* may have a spray angle that is oriented or tilted toward the centerline of the combustion assembly (e.g., as shown in FIG. 6). Alternatively, fuel nozzles 110*b* or 110*c* may have a spray angle that is oriented or tilted toward or away from the centerline of the combustion assembly.

Moreover, as described above, the spray angle and/or the flow throughput of the fuel nozzles 110*a*, fuel nozzles 110*b*, fuel nozzles 110*c* may vary. For example, the fuel nozzles 110*c* may be positioned near and/or at the centerline of the combustion assembly and may have a generally small spray angle (e.g., most of the fuel 20 exiting the fuel nozzles 110*c* may flow generally along the centerline of the combustion assembly). In some embodiments, the fuel nozzles 110*b* may be positioned at location(s) between the fuel nozzles 110*c* and the fuel nozzles 110*a* (e.g., the fuel nozzles 110*b* may be closer to the centerline than fuel nozzles 110*a* but farther than fuel nozzles 110*c*).

In some embodiments, the fuel 20 flowing from the fuel nozzles 110*a*, 110*b*, 110*c* may at least partially overlap and/or mix together and/or with oxidant that flows into the flow space 10*b*. For example, the streams of fuel 20 flowing from adjacent ones of the fuel nozzles 110*a*, 110*b*, 110*c* may overlap and/or mix. Overlapping and/or mixing fuel 20 from multiple fuel nozzles 110*a*, 110*b*, 110*c* may provide a balanced and/or substantially uniform distribution of fuel 20 and/or of fuel-oxidant mixture in the flow space 10*b*. Moreover, the fuel flows from the fuel nozzles 110*a*, 110*b*, 110*c* may be intersecting in a manner that facilitates cross-lighting of the fuel and/or stabilizing the flame formed therefrom (e.g., during a startup or heating phase, such as a phase where the flame holder is heated to an operating temperature).

The embodiment illustrated in FIG. 6 includes nozzle valves 180*a*, 180*b*, 180*c* that may control flow of fuel 20 from the fuel supply line 160*b* into the corresponding ones of the fuel nozzles 110*a*, 110*b*, 110*c* (e.g., including stopping fuel flow to any fuel nozzle). For example, as described above, the fuel distribution hub 150*b* may distribute fuel 20 among the fuel nozzles 110*a*, 110*b*, 110*c*. In some embodiments, the nozzle valves 180*a*, 180*b*, 180*c* may control flow of fuel 20 into portions and/or channels of the fuel distribution hub 150*b* that distribute the fuel 20 to the corresponding fuel nozzles 110*a*, 110*b*, 110*c*. Generally, any of the main valve 170 and nozzle valves 180*a*, 180*b*, 180*c* may be any type of a suitable valve (e.g., solenoid valve) that may be controlled manually and/or electrically.

In some embodiments, the operating capacity of the integrated combustion assembly may be reduced below 100% operating capacity. For example, the amount of fuel supplied to and combusted in the integrated combustion assembly may be reduced to an amount that is less than maximum designed amount of fuel flow. In an embodiment, the fuel flow may be reduced at a main valve, such that the fuel flow from each of the fuel nozzles 110*a*, 110*b*, 110*c* is reduced (e.g., reducing the flow speed of the fuel). Alternatively, one or more selected fuel nozzles (e.g., of the fuel nozzles 110*a*, 110*b*, 110*c*) may be disabled or may have reduced fuel flow therethrough, such that at least some of the fuel nozzles 110*a*, 110*b*, 110*c* maintain a selected (e.g., un-reduced) speed of fuel flow. For example, selectively stopping flow through one or more of the fuel nozzles 110*a*, 110*b*, 110*c*, while maintaining the speed of fuel flow out of remaining fuel nozzles 110*a*, 110*b*, 110*c* may reduce the possibility of unstable combustion and/or upstream flame propagation.

Furthermore, as described below in more detail, the combustion assembly may be operated to first heat the flame holder to a suitable temperature. For example, one or more fuel nozzles may extend closer to and/or may be positioned and configured to heat the flame holder to a suitable temperature (e.g., to a temperature at or near combustion temperature of the fuel 20). Under some operating conditions, after the flame holder is heated to the suitable temperature, the fuel-oxidant mixture may be combusted inside the flow space 10*b* (e.g., the fuel-oxidant mixture may be combusted near the flame holder, such that the flame formed from the combustion anchors to and/or positions on and/or in the flame holder).

In an embodiment, the combustion assembly may include one or more valves that may be operated to first permit flow of fuel 20 to fuel nozzle(s) heating the flame holder and subsequently permit flow of fuel 20 to fuel nozzle(s) that flow fuel in a manner that forms a flame attached to the flame holder. In some embodiments, some of the fuel may flow to the fuel nozzle(s) that direct fuel flow into the flow space and some of the fuel may flow to the fuel nozzle(s) positioned and configured to heat the flame holder (e.g., without combusting fuel inside the flow space). For example, the combustion assembly may include a bypass valve that may be operated to divert at least a portion (e.g., from about 1% to about 100%, such as 30%) of the fuel to the fuel nozzle(s) positioned and configured to heat the flame holder and away from the fuel nozzle(s) positioned and configured to flow fuel into the flow space, and vice versa. Hence, for example, the bypass valve may control the flow of fuel to the fuel nozzles that heat the flame holder, thereby controlling heating of the flame holder. It should be appreciated that the bypass valve may be operated in any suitable manner (e.g., the bypass valve by controlled directly or indirectly by a controller and/or may be controlled manually).

Figure 7A:
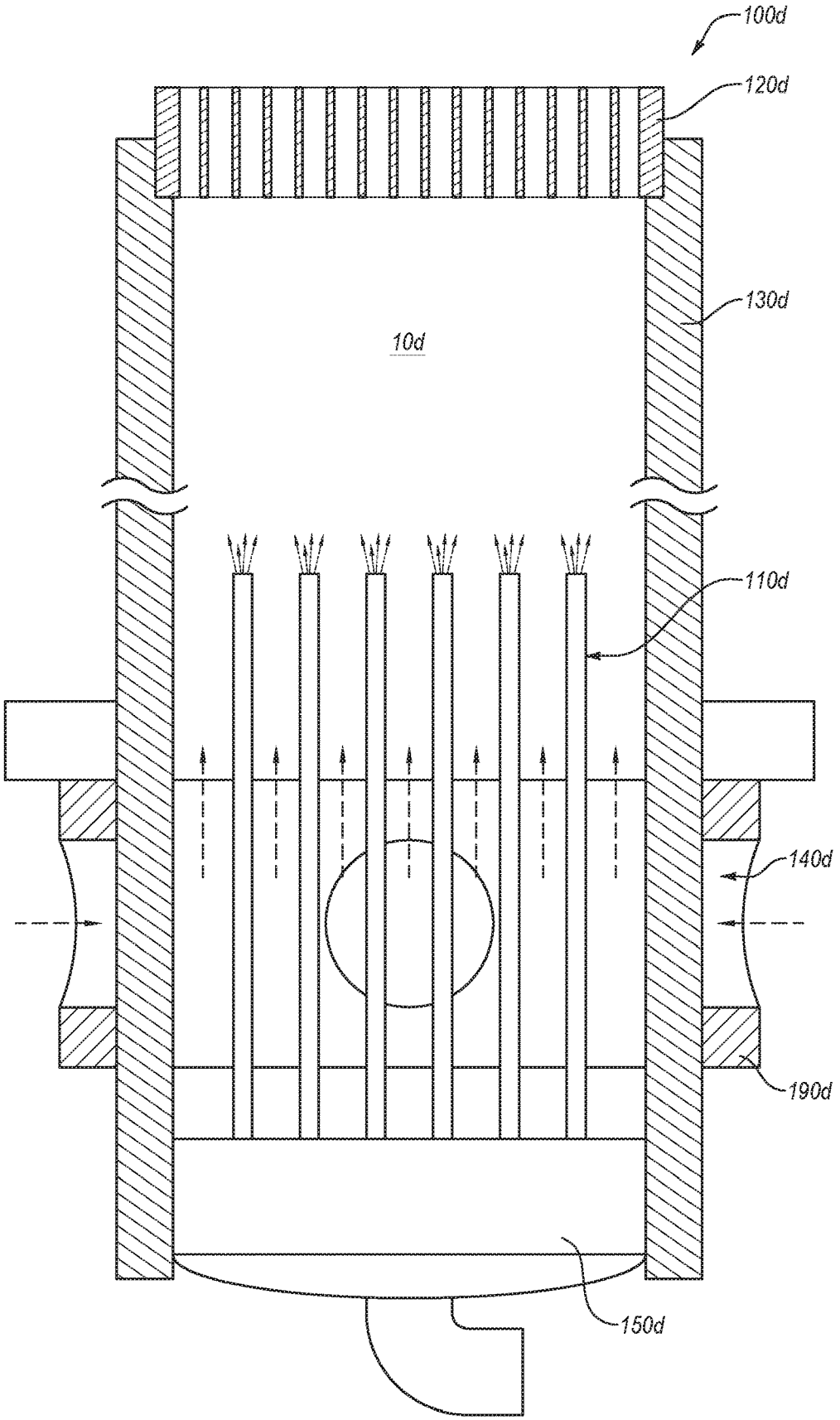
FIG. 7A is a cross-sectional view of an integrated combustion assembly, according to an embodiment.

As described above, the combustion assembly may have any number of suitable configurations. FIG. 7A is a cross-sectional view of an integrated combustion assembly 100*d*, according to an embodiment. Except as otherwise described herein, the integrated combustion assembly 100*d* and its elements and components may be similar to or the same as any of the integrated combustion assemblies 100, 100*a* (FIGS. 1, 5A) and their corresponding elements and components. For example, the integrated combustion assembly 100*d* may include fuel nozzles 110*d* connected to fuel distribution hub 150*d* and perforated flame holder 120*d* secured to and/or positioned on support 130*d* downstream from the fuel nozzles 110*d*, which may be similar to or the same as the fuel nozzles 110, flame holder 120, supports 130, fuel distribution hub 150 of the integrated combustion assembly 100 (FIG. 1).

In an embodiment, the integrated combustion assembly 100*d* may include one or more oxidant inlets 140*d* that may allow and/or regulate flow of oxidant into flow space 10*d*, such as air or other suitable oxidant. For example, the fuel distribution hub 150*d* and the support 130*d* may be connected in a manner that seals the bottom of the integrated combustion assembly 100*d* (e.g., such as to prevent or limit oxidant flowing through the fuel distribution hub 150*d* and/or between the support 130*d* and fuel distribution hub 150*d*). Alternatively, the bottom of the integrated combustion assembly 110*d* may be at least partially unsealed. In some embodiments, at a lower portion of the support 130*d* may be generally tubular and the fuel distribution hub 150*d* may be attached to the lower portion of the support 130*d* (e.g., welded and/or fastened) in a manner that forms a seal and to generally prevent or limit oxidant from entering therebetween.

In some embodiments, the integrated combustion assembly 100*d* may include at least one flow control ring 190*d* that may include or form at least a portion of at least one of the oxidant inlets 140*d*. For example, the support 130*d* may have one or more openings that may be aligned with corresponding one or more openings in the flow control ring 190*d* to allow and/or regulate flow of oxidant into the flow space 10*d*. Generally, the amount of oxidant supplied into the flow space 10*d* may vary from one embodiment to the next. Hence, for example, the openings in the flow control ring 190*d* and/or in the support 130*d* may be generally aligned in a manner that may form one or more suitable oxidant inlets, such as oxidant inlets 140*d*, to supply a suitable and/or selected amount of oxidant into the flow space 10*d*.

As shown in FIG. 7A, in some embodiments, oxidant may flow generally orthogonally relative to a longitudinal axis of the integrated combustion assembly 100*d* and/or relative to the general downstream direction of the fuel from the fuel nozzles 110*d*, as the oxidant enters the oxidant inlets 140*d*. For example, combined or bulk fuel flow in flow space 10*d* may approach a trajectory that is generally parallel to the centerline of the integrated combustion assembly 100*d*. In the illustrated embodiment, the oxidant inside the flow space 10*d* may flow substantially in the downstream direction of fuel flow, such as substantially parallel to the longitudinal axis of the integrated combustion assembly 100*d*. It should be also appreciated that oxidant may enter and/or flow in the flow space 10*d* in any direction or orientation (e.g., relative to the longitudinal axis of the integrated combustion assembly 100*d* or the downstream direction of the fuel flow). For example, oxidant may enter the flow space 10*d* along a direction that is generally orthogonal relative to the downstream direction of the fuel flow and/or relative to the longitudinal axis of the integrated combustion assembly 110*d*. Moreover, in at least one embodiment, the oxidant may flow inside the flow space 10*d* along a direction that is generally orthogonal relative to the downstream direction of the fuel flow and/or relative to the longitudinal axis of the integrated combustion assembly 110*d*.

Furthermore, the relative alignment of the flow control ring 190*d* and the support 130*d* may be fixed (e.g., with fasteners, welding, etc.). Alternatively, the flow control ring 190*d* may be movable or rotatable relative to the support 130*d* (e.g., relative to the lower portion of the supper 130*d*). For example, pivoting the flow control ring 190*d* relative to the lower portion of the support 130*d*, such as to change the relative alignment between the support 130*d* and the flow control ring 190*d*, may change the shape and/or size of the oxidant inlets, such as oxidant inlets 140*d*, thereby regulating or controlling the flow of oxidant into the flow space 10*d* (e.g., controlling the amount or volume and/or speed of flow of the oxidant). In an embodiment, the relative positions and/or alignment between the flow control ring 190*d* and the lower portion of the support 130*d* may be maintained by suitable friction therebetween.

Figure 7B:
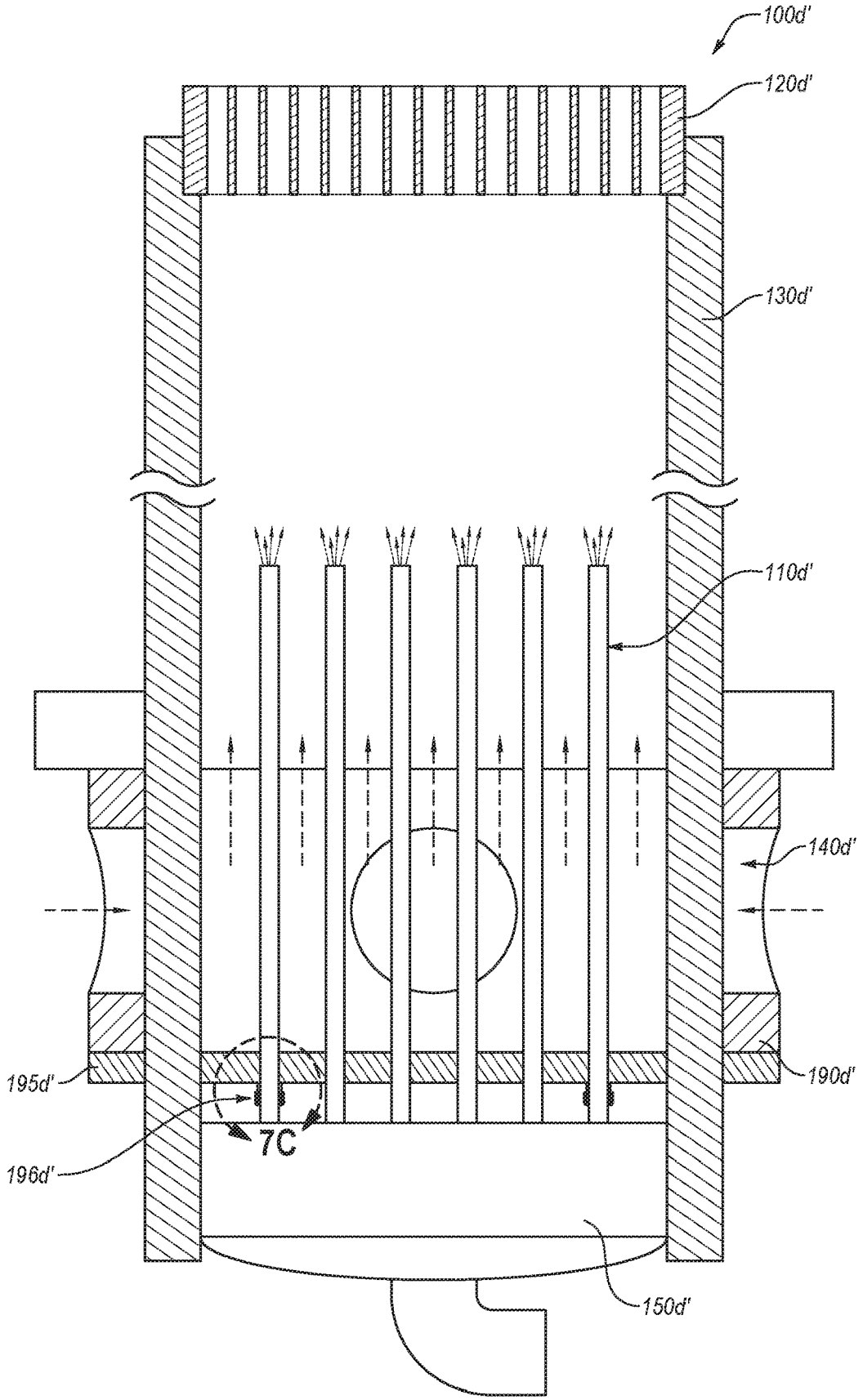
FIG. 7B is a cross-sectional view of an integrated combustion assembly, according to another embodiment.

In some embodiments, one, some, or all of the fuel nozzles may be adjusted and/or may be adjustable relative to the flame holder (e.g., without disassembling the integrated combustion assembly). For example, as shown in FIG. 7B, an integrated combustion assembly 100*d*' may include height-adjustable fuel nozzles 110*d*'. Except as otherwise described herein, the integrated combustion assembly and its elements and components may be similar to or the same as the integrate combustion assembly 100*d* (FIG. 7A) and its corresponding elements and components. For example, the integrated combustion assembly 100*d*' may include multiple fuel nozzles 110*d*' positioned generally upstream from perforated flame holder(s) 120*d*' that may be supported by supports 130*d*', which may be similar to or the same as the fuel nozzles 110*d*, flame holder 120*d*, and supports 130*d* of the integrated combustion assembly 100*d* (FIG. 7A).

In an embodiment, the flow control ring 190*d*' may be secured to the supports 130*d*'. For example, a backup plate 195*d*' may be secured to the supports 130*d*' and may secure the flow control ring 190*d*' thereto. In some embodiments, one, some, or each of the fuel nozzles 110*d*' may include an independent control valve that may regulate or control fuel flow therethrough. For example, the fuel valve(s) may be positioned downstream from fuel distribution hub 150*d*' that supplies fuel to the fuel nozzles 110*d*'.

The backup plate 195*d*' may be attached to the flow control ring 190*d* or may be integrated therewith. Moreover, the backup plate 195*d*' may at least partially secure the fuel nozzles 110*d*' and fuel distribution hub 150*d*' connected thereto. For example, the integrated combustion assembly 100*d*' may include connector elements 196*d*' that may secure the fuel nozzles 110*d*' together with the fuel distribution manifold 150*d*' to the supports 130*d*', thereby positioning the fuel nozzles 110*d*' at a selected distance from the flame holder 120*d*'. Furthermore, the connector elements 196*d*' may releasably secure the fuel nozzle 110*d*', such that the fuel nozzles 110*d*' may be selectively repositioned (e.g., relative to the flame holder 120*d*').

Figure 7C:
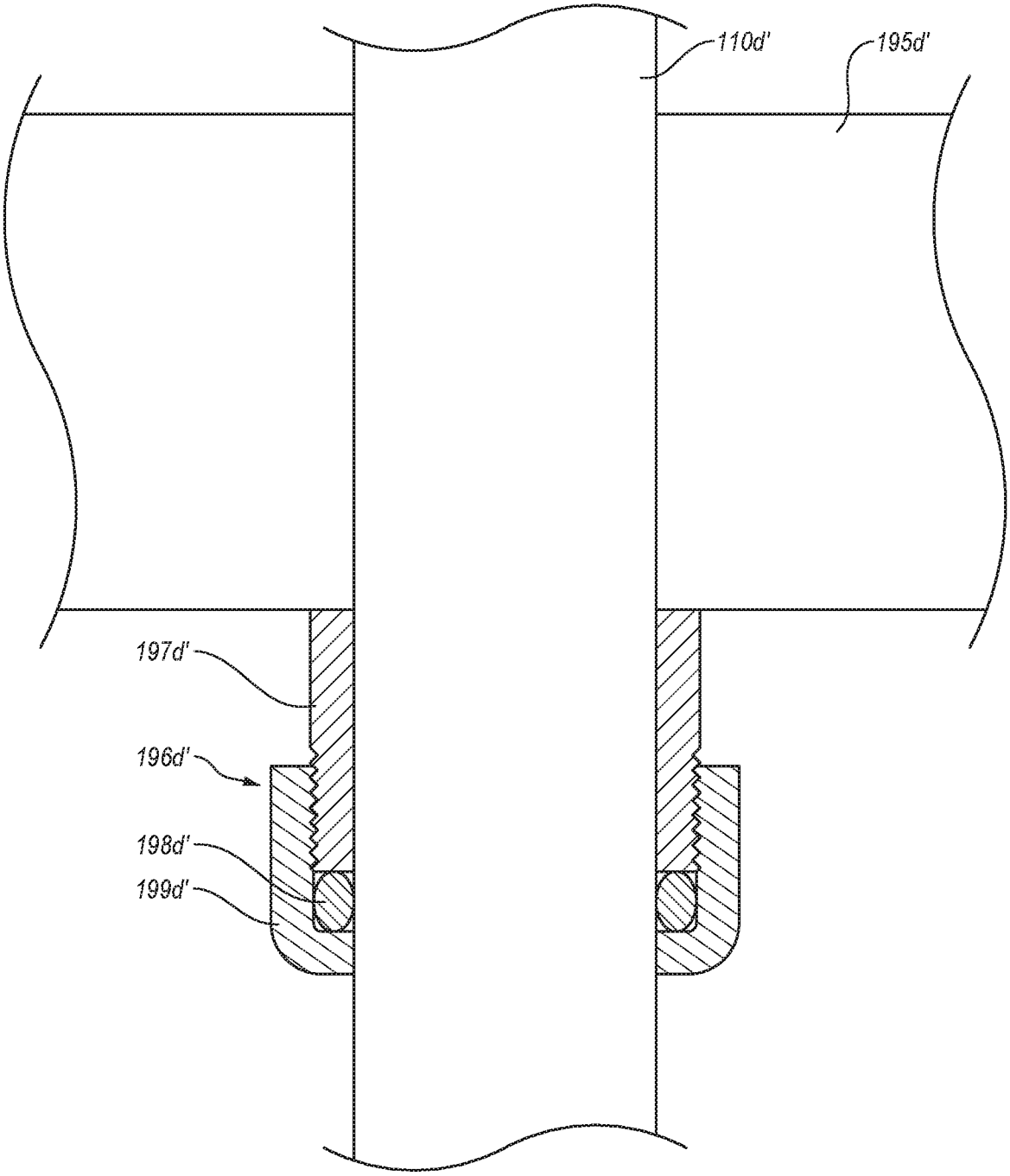
FIG. 7C is an enlarged cross-sectional view of a portion of the integrated combustion assembly of FIG. 7B.

Generally, the connector elements 196*d*' may have any number of suitable configurations for selectively securing the fuel nozzles 110*d*'. FIG. 7C illustrates an enlarged cross-sectional view of the connector elements 196*d*' securing the fuel nozzles 110*d*' to the backup plate 195*d*'. For example, the connector element 196*d*' may include an upper portion 197*d*' connected or secured to the backup plate 195*d*', an elastic washer 198*d*' positioned adjacent to the upper portion 197*d*' and at least partially surrounding the fuel nozzle 110*d*', and a lower portion 199*d*' connectable to the upper portion (e.g., via threaded connection, as shown in FIG. 7C) in a manner that compresses the elastic washer 198*d*' therebetween. More specifically, for example, axially compressing the elastic washer 198*d*' may laterally expand the elastic washer 198*d*', such that the elastic washer 198*d*' compresses about the fuel nozzle 110*d*', thereby securing the fuel nozzle 110*d*' to the connector element 196*d*'. It should be appreciated that an integrated combustion assembly may include any suitable number of connector elements that may secure the fuel nozzles at any number of selected positions and/or distances relative to the flame holder (e.g., without disassembling the integrated combustion assembly).

Figure 8A:
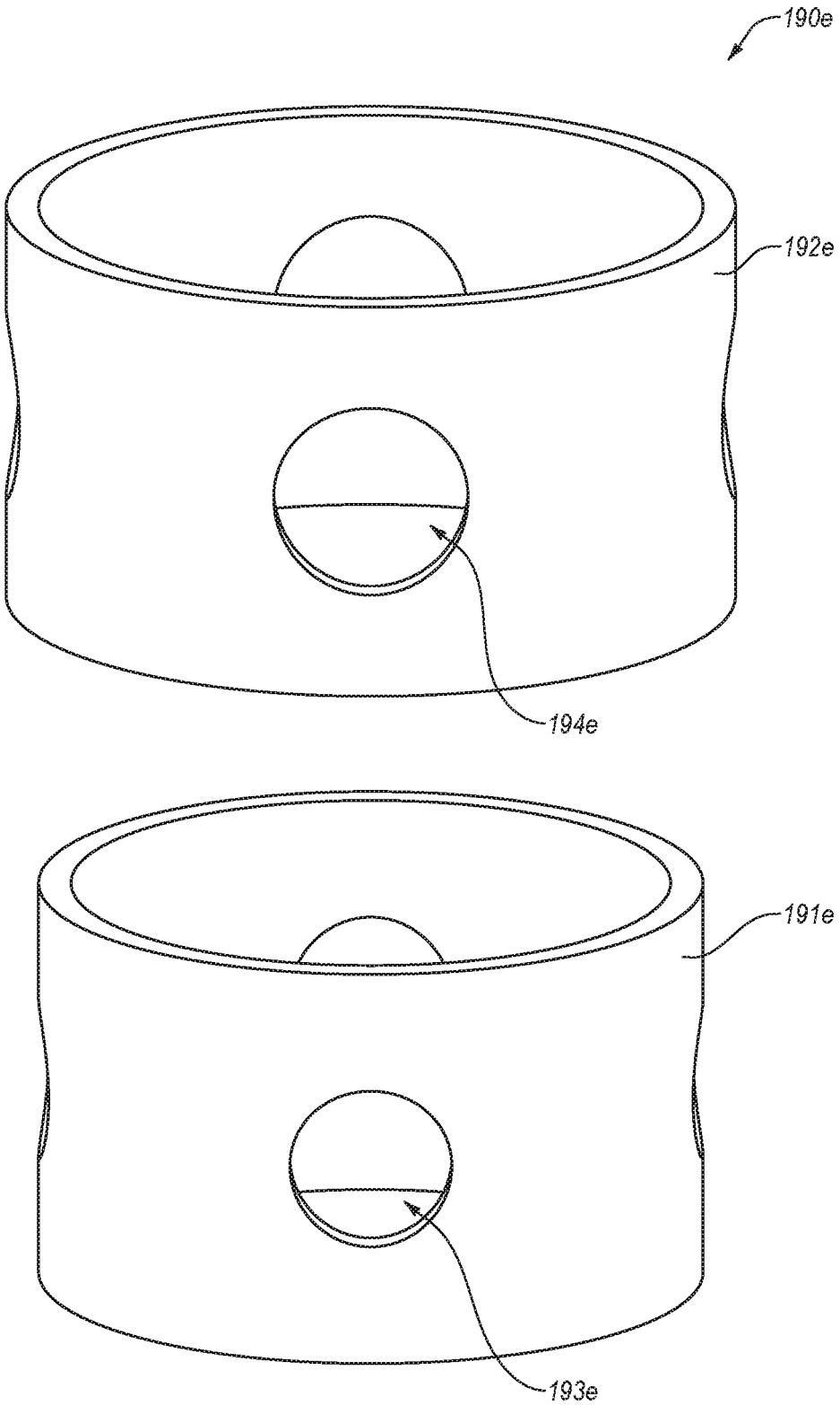
FIG. 8A is an exploded, isometric view of a flow ring assembly, according to an embodiment.

In some embodiments, the combustion assembly may include multiple flow control rings (e.g., a first flow control ring may be attached to or integrated with the support of the combustion assembly, and a second flow control ring may be movable and/or pivotable relative to the first flow control ring). FIG. 8A shows an exploded, isometric view of flow ring assembly 190*e* according to an embodiment. It should be appreciated that the flow ring assembly 190*e* may be included and/or incorporated into any of the integrated combustion assemblies described herein. In an embodiment, the flow ring assembly 190*e* may include an inner ring 191*e* and an outer ring 192*e* that may fit over the inner ring 191*e*.

The inner and outer rings 191*e*, 192*e* may have and/or define respective openings 193*e*, 194*e*. Specifically, the openings 193*e*, 194*e* may extend through the respective walls of the inner and outer rings 191*e*, 192*e*. Hence, for example, when the inner ring 191*e* is positioned inside the outer ring 192*e*, at least partially aligning the openings 193*e*, 194*e* may form or define oxidant inlets, such that the oxidant located outside of the outer ring 192*e* may flow through the oxidant inlets, through the flow ring assembly 190*e*, and into flow space. For example, the flow control ring 190*d* of the integrated combustion assembly 100*d* (FIG. 7A) may be replaced with the flow ring assembly 190*e*, and the oxidant may flow through the oxidant inlets defined or formed by the openings 193*e*, 194*e* in the respective inner and outer rings 191*e*, 192*e*, into the inner space of the inner ring 191*e*, and into the flow space 10*d* (see FIG. 7A).

Generally, the openings 193*e*, 194*e* may have any suitable size, shape, location on the respective rings, combinations thereof, etc., which may vary from one embodiment to the next. Moreover, the inner and/or outer ring 191*e*, 192*e* may have any suitable number of openings. In some embodiments, the openings 193*e*, 194*e* may be approximately the same size and/or shape, and the inner and outer rings 191*e*, 192*e* may be positioned and oriented such that the openings 193*e*, 194*e* are aligned to define oxidant inlets that have approximately the same size and shape as the openings 193*e*, 194*e* (e.g., the flow ring assembly 190*e* may have fully open oxidant openings configuration). Alternatively, the openings 193*e*, 194*e* may be misaligned, such as to define or form oxidant inlets that have different shape and/or size than the openings 193*e*, 194*e* (e.g., when the openings 192*e*, 193*e* are misaligned, the oxidants may be smaller than when the openings 192*e*, 193*e* are substantially aligned. Hence, for example, when the openings 193*e*, 194*e* are misaligned, a smaller oxidant inlet formed thereby (as compared with the configuration where the openings 193*e*, 194*e* are aligned) may impede flow of oxidant into the flow space as compared with the fully open configuration of the oxidant inlets in the flow ring assembly 190*e*.

Generally, the inner and outer rings 191*e* and 192*e* may be oriented relative to one another by any number of suitable mechanisms. In an embodiment, the inner ring 191*e* and/or outer ring 192*e* may be manually rotated to suitable orient the respective openings 193*e*, 194*e* relative to one another (e.g., such as to facilitate a suitable oxidant flow therethrough). Alternatively or additionally, the inner ring 191*e* and/or outer ring 192*e* may be rotated by one or more rotation mechanisms (e.g., a motor). For example, the inner ring 191*e* and/or outer ring 192*e* may have a geared connection with a motor that may rotate the inner ring 191*e* and/or outer ring 192*e*. In an embodiment, a controller may be operably coupled to the motor and may control relative orientation of the inner ring 191*e* and/or outer ring 192*e* and the respective openings 193*e*, 194*e* relative to one another, such as to produce a selected or suitable oxidant flow therethrough.

Generally, the shapes of the openings may be configured to produce a suitable change in the opening produced therebetween as the inner and outer rings are reoriented relative to each other. For example, the area of the opening formed by the misaligned opening openings of the inner and outer rings may change linearly or nonlinearly related to a linearly changing relative radial reorientation of inner and outer rings (e.g., area change of the opening per radiant or per degree of relative reorientation of the inner and outer rings).

For example, openings in the inner and outer rings, which have substantially uniform cross-sectional shape (e.g., a rectangular projection onto a cylinder) may produce a linearly changing area of an opening formed thereby in response to linearly changing angular orientation of the inner and outer rings. Alternatively, as shown in the illustrated embodiment, substantially circular openings 192*e*, 193*e* (e.g., circular projections onto the cylinders of the inner and outer rings 191*e*, 192*e*) form an opening with the area that changes nonlinearly in response to linearly changing relative orientation of the inner and outer rings 191*e*, 192*e* (e.g., the area changes nonlinear in response to single degree-incremented or radian-incremented relative reorientation of the inner and outer rings 191*e*, 192*e*).

Figure 8B:
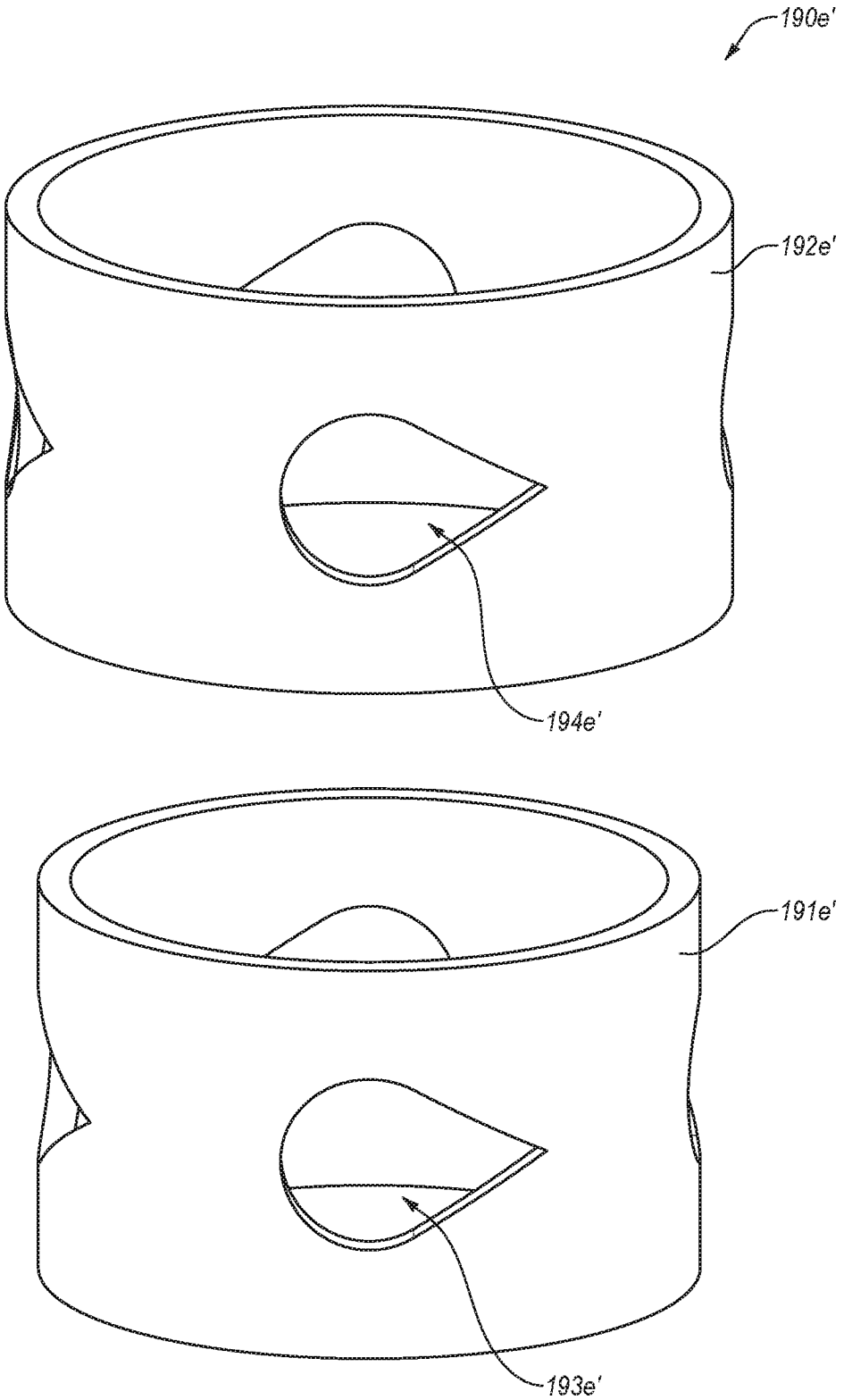
FIG. 8B is an exploded, isometric view of a flow ring assembly, according to another embodiment.

As mentioned above, the openings 193*e*, 194*e* of the respective inner and/or outer rings 191*e*, 192*e* may have any number of suitable shapes. As shown in FIG. 8B, for example, inner ring 191*e*' and outer ring 192*e*' of a flow ring assembly 190*e*' may have generally teardrop-shaped respective openings 193*e*', 194*e*'. Except as described herein, the flow ring assembly 190*e*' and its elements and components may be the same as or similar to the flow ring assembly 190*e* (FIG. 8A) and its respective elements and components. For example, the openings 192*e*', 193*e*' (e.g., circular projections onto the cylinders of the inner and outer rings 191*e*', 192*e*') may form an opening with the area that changes nonlinearly in response to linearly changing relative orientation of the inner and outer rings 191*e*', 192*e*' (e.g., the area changes nonlinear in response to single degree-incremented or radian-incremented relative reorientation of the inner and outer rings 191*e*', 192*e*').

Figure 9:
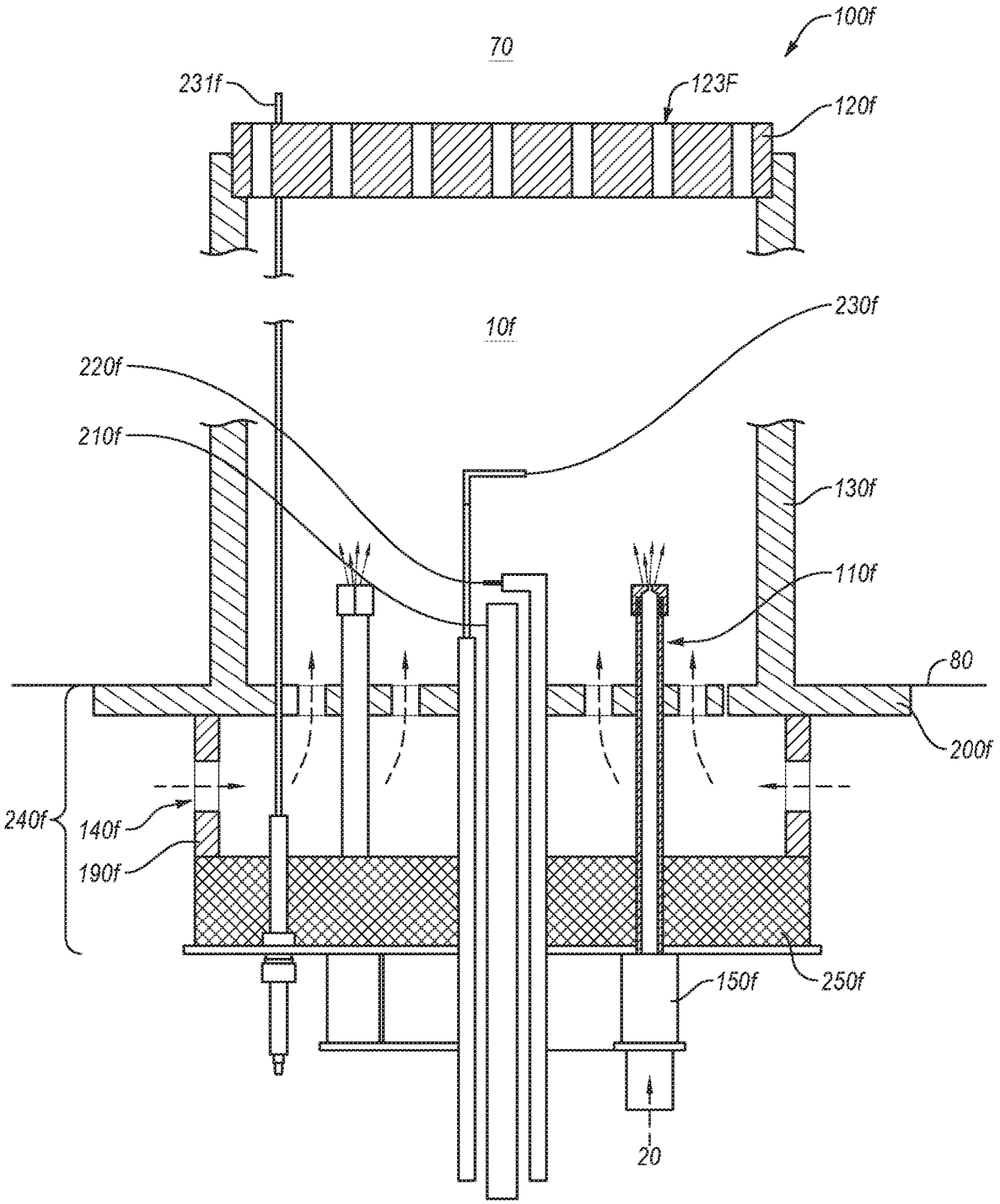
FIG. 9 is a cross-sectional view of an integrated combustion assembly, according to an embodiment.

In some embodiments, an integrated combustion assembly may include one or more elements or components for starting and/or controlling combustion. Moreover, an integrated combustion assembly may be included or secured to a heater (e.g., to heat a space, fluids, etc.). FIG. 9 is a cross-sectional view of an integrated combustion assembly 100*f* at least partially positioned inside a heating space 70, according to an embodiment. Except as otherwise described herein, the integrated combustion assembly 100*f* and its elements and components are similar to or the same as any of the integrated combustion assemblies 100, 100*a*, 100*d* (FIGS. 1, 5A, 7A) and their respective elements and components.

For example, similar to the integrated combustion assembly 100 (FIG. 1), the integrated combustion assembly 100*f* may include fuel nozzles 110*f* connected and/or secured to fuel distribution hub 150*f* and may include a perforated flame holder 120*f* positioned downstream from the fuel nozzles 110*f* and on support 130*f* (e.g., the perforated flame holder 120*f* may include apertures 123*f* that may be similar to or the same as any of the flame holder apertures described herein). Generally, fuel 20 may exit the fuel nozzles 110*f* into flow space 10*f* and may be combusted therein. In some embodiments, the flow space 10*f* and the flame holder 120*f* of the integrated combustion assembly 100*f* may be positioned inside the heating space 70. For example, the integrated combustion assembly 100*f* may include a mounting flange 200*f* that may be secured to a support 80 of a heater or a heating unit, such that a suitable portion of the integrated combustion assembly extends into the heating space 70 of the heating unit.

In an embodiment, the integrated combustion assembly 100*f* may include a pilot 210*f* that may be lit by igniter 220*f*. For example, the igniter may be an electrical spark igniter that may provide a spark to light the pilot flame or other suitable igniter. It should be appreciated that the pilot flame produced by the pilot 210*f* may ignite fuel 20 flowing downstream from the fuel nozzles 110*f* inside the flow space 10*f*. Moreover, the pilot 210*f* may produce suitable or sufficient flame to heat the flame holder 120*f* to an operating temperature.

In some embodiments, the integrated combustion assembly 100*f* includes a flame sensor 230*f* that may detect ignition of the fuel 20 and a pilot flame formed from such ignition. As described below in more detail, the flame sensor 230*f* may be operably coupled to a controller that may receive signals therefrom and may, at least partially based on the signals, operate fuel valves (e.g., as described above), igniter(s), oxidant supply, combinations thereof, etc., as well as otherwise control combustion of the fuel inside the flow space 10*f*. In an embodiment, the integrated combustion assembly 100*f* may include at least a second flame sensor 231*f*, which may be positioned at or near the flame holder 120*f*. For example, based on the signals from the flame sensor 231*f*, the controller may determine that the flame is moving from the flow space 10*f* to the flame holder 120*f*.

The flame sensor 231*f* may measure one or more combustion parameters (e.g., temperature, opacity, or combinations thereof) of the flame to, for example, determine position of the flame. For example, the flame sensor 231*f* may include thermal sensors, electrical sensors, optical sensors (e.g., UV and/or IR sensors, such as UV scanners), other suitable sensors, or combinations thereof. Additionally, the flame sensor 231*f* may be configured to measure combustion parameters, such as a fuel particle flow rate, gas temperature, gas optical density, combustion volume temperature and/or pressure, luminosity, level of acoustics, combustion volume ionization, or combinations thereof.

In some embodiments, as described above, the oxidant may enter the flow space 10*f* through oxidant inlets 140*f* that may be formed or defined one or more flow control rings 190*f*. In an embodiment, the flow control ring(s) 190*f* may be positioned below (e.g., in upstream direction and away from the flow space 10*f*) the mounting flange 200*f*. Moreover, the flow control ring(s) 190*f* may extend about a centerline of the integrated combustion assembly 100*f*. As shown in FIG. 9, for example, at least some or all of the fuel nozzles 110*f* may be at least partially positioned below the mounting flange 200*f* and may be surrounded by the flow control ring(s) 190*f* (e.g., each of the fuel nozzles 110*f* may include a riser and flow tip connected to the riser, and the riser may extend between the flow space 10*f* and a location below the mounting flange 200*f*). Furthermore, the fuel distribution hub 150*f* supplying the fuel 20 to the fuel nozzles 110*f* may be positioned below the mounting flange 200*f*.

Generally, the flow of oxidant into the flow space 10*f* may be restricted to the flow through the openings in the flow control ring(s) 190*f* (i.e., through the oxidant inlets 1400. For example, the flow control ring(s) 190*f* may extend between the fuel distribution hub 150*f* and the mounting flange 200*f* and may at least substantially close the space therebetween, leaving the openings in the flow control ring(s) 190*f* to define the path and/or channels (i.e., oxidant inlets 1400 for the oxidant to flow into the flow space 10*f*.

In an embodiment, generally, the space defined by the flow control ring(s) 190*f* may be in fluid communication with the flow space 10*f*, such that the oxidant may flow from the space in the flow control ring(s) 190*f* into the flow space 10*f*. For example, the integrated combustion assembly 100*f* may include one or more openings extending from the space defined by the flow control ring(s) 190*f* and into the flow space 10*f*. For example, the space defined by the flow control ring(s) 190*f* may be separated from the flow space 10*f* by a barrier or a plate that may include the openings that connect the space in the flow control ring(s) 190*f* and the flow space 10*f* for the oxidant to flow from the flow control ring(s) 190*f* into the flow space 10*f*. Alternatively, the space in the flow control ring(s) 190*f* may open directly into the flow space 10 substantially without any barriers or impediments.

Inside the flow space 10*f*, the oxidant may mix with the fuel 20 and may be ignited. Furthermore, the flame may initially heat the flame holder 120*f* to a suitable and/or selected temperature (e.g., the flame holder 120*f* may be heated with the flame formed by igniting fuel 20 from the fuel nozzles 110*f* and/or from additional or alternative fuel nozzles, such as fuel nozzles (not shown) positioned and configured to heat the flame holder 120*f*).

In some embodiments, a lower portion 240*f* of the integrated combustion assembly 100*f* may be closed or sealed at a bottom thereof, such that the oxidant may enter the flow space 10*f* through oxidant inlets 140*f*, which may extend through sides of the lower portion 240*f*. For example, the one or more flow control rings 190*f*, which may be similar to or the same as the flow control ring 190*d* (FIG. 7A) or flow ring assembly 190*e* (FIG. 8A) may regulate the amount of oxidant entering the flow space 10*f*, as described above. Additionally or alternatively, at least part of the lower portion 240*f* may be insulated. For example, insulation barrier 250*f* may at least partially cover and/or surround the lower portion 240*f* (e.g., the insulation barrier 250*f* may surround the lower portion 240*f* at a portion near a bottom thereof, as shown in FIG. 9). Under some operating conditions, the insulation barrier 250*f* may improve heat transfer from the combusted fuel in the flow space 10*f* to the heating space 70.

In an embodiment, a controller may receive signals from the flame sensors 230*f* and/or 231*f* and may control and/or direct operation of the valve(s) controlling flow to the fuel nozzles 110*f* and/or to fuel nozzle(s) positioned and configured to preheat the flame holder 120*f*. For example, the controller may operate one or more valves to reduce or stop flow to the fuel nozzle(s) preheating the flame holder 120*f* when the flame sensor 231*f* detects flame thereon, and the control receives corresponding signal(s) from the flame sensor 231*f*. Moreover, the controller may control and/or direct operation of the valve(s) supplying fuel to the fuel distribution hub 150*f* (e.g., in response to receiving a signal from the flame sensors 230*f* and/or 231*f*, indicating presence of the flames in the flow space 10*f*, the controller may direct at least a portion of the flow from the fuel distribution hub 150*f* and/or from the fuel nozzles 110*f* to one or more other fuel nozzles that may preheat the flame holder 120*f*, for example, until the flame holder 120*f* reaches a suitable temperature and/or the flame sensor 231*f* detects flame anchored at the flame holder 120*f*.

Figure 10:
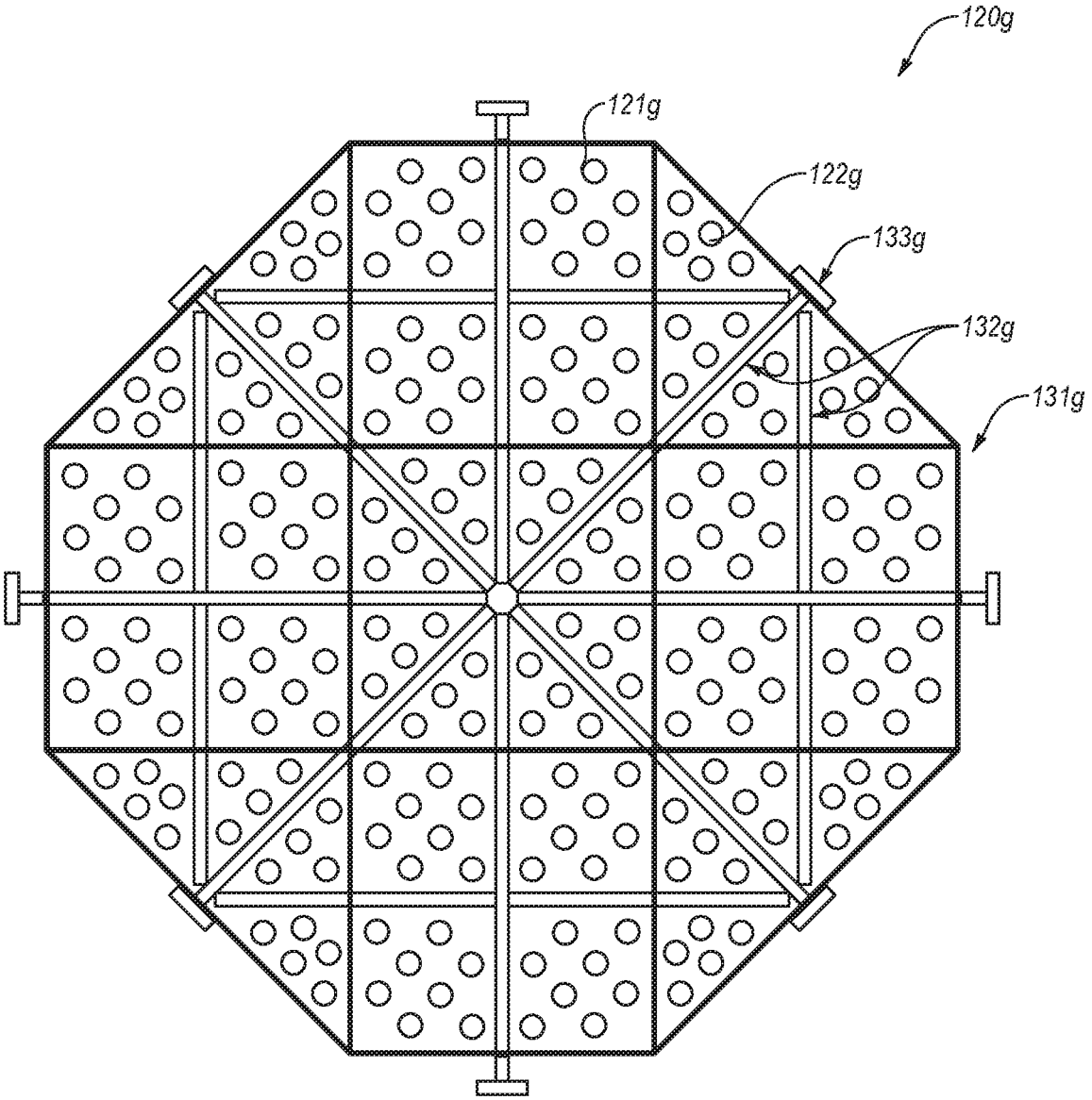
FIG. 10 is a schematic top view of a flame holder and a support rack, according to an embodiment.

Generally, the integrated combustion assembly may have any number of flame holders that may have any number of suitable configurations (e.g., hole sizes, shapes, and arrangements) and/or may have any number of suitable sizes (e.g., thicknesses and/or peripheral dimensions). In some embodiments, the flame holder may have multiple segments that may collectively define upstream and downstream surfaces of the flame holder. FIG. 10 illustrates a top view of a perforated flame holder 120*g* that includes multiple segments 121*g* and 122*g*, according to an embodiment. Except as described herein, the flame holder 120*g* and its elements and components may be similar to or the same as any of the flame holders described herein. For example, the segments 121*g* and 122*g* may have multiple openings or apertures (not shown) extending through respective bodies thereof. Moreover, the flame holder 120*g* may be included or incorporated into any integrated combustion assembly described herein.

As shown in FIG. 10, the flame holder 120*g* includes segments 121*g* and 122*g* arranged in a manner that defined the peripheral shape of the flame holder 120*g* (e.g., the segments 121*g* and 122*g* may collectively define a generally octagonal shape of the flame holder 120*g*). It should be appreciated, however, that the flame holder 120*g* may have any suitable shape, which may vary from one embodiment to the next (e.g., the flame holder 120*g* may be generally round, square, etc.). In an embodiment, the segments 121*g* and 122*g* may be secured by a support rack 131*g* that, in turn, may be supported and/or secured by the support(s) of the integrated combustion assembly. For example, the support rack 131*g* may be generally configured as a grid of connected and/or overlapping support members 132*g*.

In some embodiments, the segments 121*g* and/or 122*g* may be at least partially secured in place by one or more end plates 133*g* that may be connected to and/or integrated with at least some of the support members 132*g*. More specifically, for example, the end plates 133*g* may prevent or limit lateral movement of the one, some, or each of the segments 121*g* and 122*g*. In an embodiment, the segments 121*g* and 122*g* may be fastened, welded, or otherwise secured to the end plates 131*g*. Alternatively, the weight of the segments 121*g* and 122*g* and/or friction therebetween may be suitable or sufficient to maintain the segments 121*g* and 122*g* generally stationary relative to the support rack 131*g* during operation.

Figure 11A:
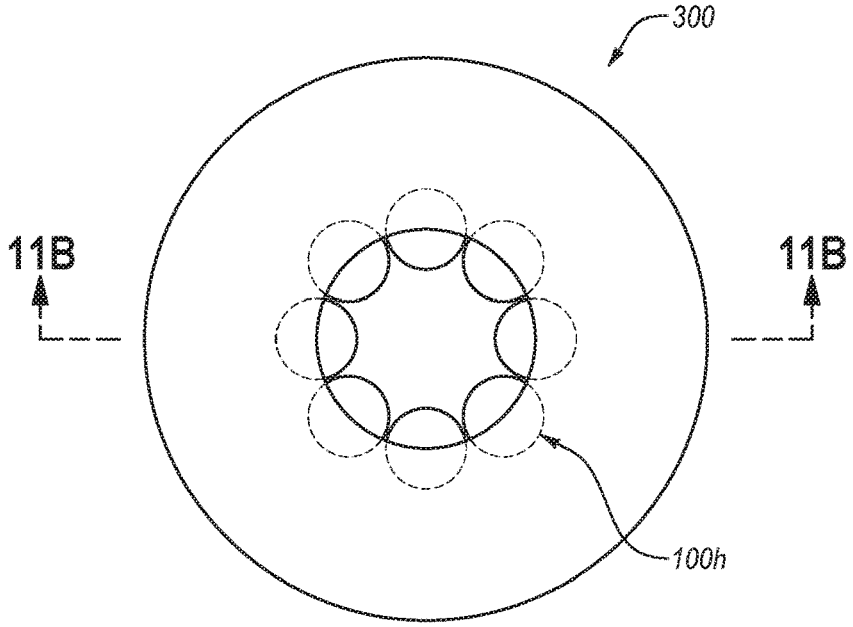
FIG. 11A is a schematic top view of a heating unit, according to an embodiment.
Figure 11B:
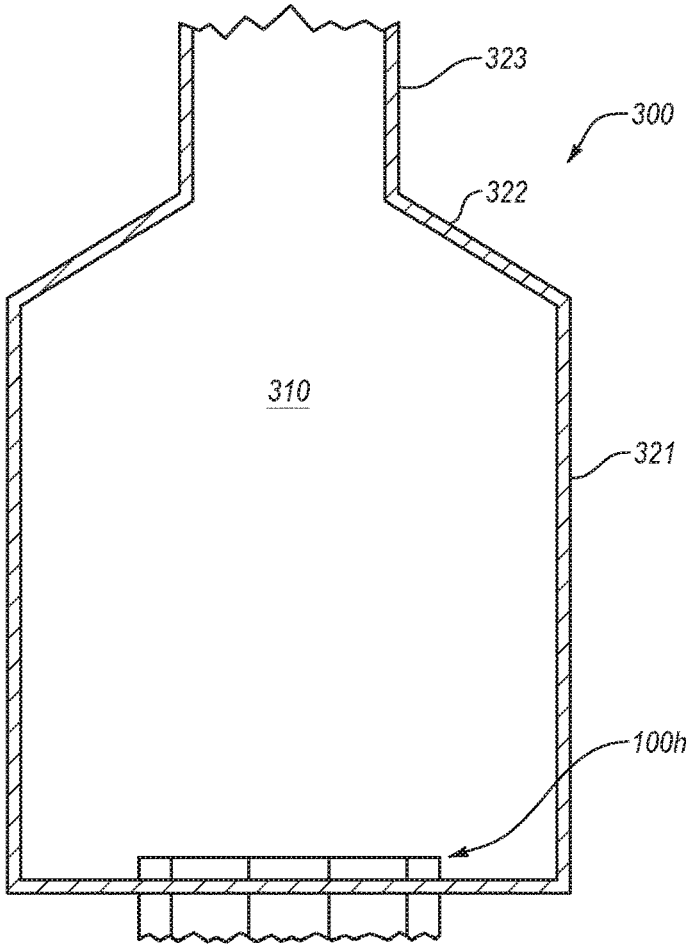
FIG. 11B is a schematic cross-sectional view of the heating unit shown in FIG. 11A.

Any of the integrated combustion assemblies described herein may be included and/or retrofitted into any number of suitable (new and/or existing) heating units (e.g., heaters, boilers, etc.). FIGS. 11A and 11B illustrate a heating unit 300 that includes integrated combustion assemblies 100*h*, according to an embodiment. Generally, the heating unit 300 may include any number of the integrated combustion assemblies 100*h*, which may be positioned in any number of configurations and/or patterns, as may be suitable for heating an interior space 310 of the heating unit 300. Moreover, the integrated combustion assemblies 100*h* may be similar to or the same as any of the integrated combustion assemblies described herein.

In an embodiment, at least some of the integrated combustion assemblies 100*h* are secured to and/or near a bottom of the heating unit 300. For example, the bottom of the heating unit 300 may define and/or enclose the interior space 310 into which the integrated combustion assemblies 100*h* may extend. As described above, the integrated combustion assemblies 100*h* may include a flange that may be secured to the bottom of the heating unit (e.g., fastened, welded, or otherwise secured to the bottom).

In an embodiment, the integrated combustion assemblies **100*h* may be positioned along a substantially circular path (e.g., the heating unit 300 may include eight integrated combustion assemblies 100*h*). In any event, the heating unit 300 may include a suitable number of the integrated combustion assemblies 100*h* that may have suitable heat output to heat the interior heating space 310 of the heating unit 300**.

Generally, the interior heating space 310 of the heating unit 300 may be defined by a shell that may include one or more walls, such as by walls 321, 322, 323. It should be appreciated, however, that the heating unit 300 may have any number of suitable shapes, sizes, configurations, etc. Moreover, the integrated combustion assembly **100*h* may have any suitable orientation when secured in and/or integrated with the heating unit 300. In the illustrated embodiment, the integrated combustion assemblies 100*h* are oriented generally vertically. Alternatively or additionally, the integrated combustion assemblies 100*h* may have any number of suitable orientations (e.g., angled, horizontal, etc.). Furthermore, the integrated combustion assemblies 100*h* may heat the interior heating space 310 and/or any number of suitable media in the heating unit 300** (e.g., gas, liquid, etc.).

As described above, the integrated combustion assemblies **100*h* may be used to retrofit an existing heating unit or system. Under some operating conditions, the existing heating unit may be upgraded or retrofitted to include the integrated combustion assemblies 100*h* without shutting down or stopping operation of such heating unit. For example, the existing combustion assemblies or burners may be removed and/or disassembled from the heating unit (e.g., from the heating unit 300**) one at a time.

Moreover, when an existing burner is removed from the heating unit, such burner may be replaced with an integrated combustion assembly, such as an integrated combustion assembly **100*h*. That is, for example, one or more burners of the heating unit may remain operating, while at least one burner is removed and replaced with the integrated combustion assembly 100*h*. Also, as mentioned above, the integrated combustion assembly 100*h* may include all elements and/or components integrated or assembled or preassembled together, such that the integrated combustion assembly 100*h* may be placed into operation as a single unit. For example, the integrated combustion assembly 100*h*** may be suitably sized and shape to fit into the opening or space vacated by the burner removed from the heating unit.

Accordingly, for example, the integrated combustion assemblies **100*h* may be preassembled offsite (e.g., at a fabrication facility) and may be ready for onsite installation without further assembly. For example, the integrated combustion assemblies 100*h* may be preassembled before installation and/or before removal of one or more of the existing burners from service. For example, the flame holder may be positioned at a preselected downstream distance from the fuel nozzles of each of the integrated combustion assemblies 100*h*. This preselected downstream distance may vary from application to the next and may be set offsite at the fabrication facility and, in some embodiments, may be adjusted as desired or needed onsite at the installation site. In any case, according to an embodiment, the existing burners in the heating unit may be removed and replaced (e.g., one or more at a time) with the integrated combustion assemblies 100*h* until a selected or suitable number of integrated combustion assemblies 100*h* is placed into operation (e.g., until the integrated combustions assemblies replace all existing burners in the heating unit 300**).

Generally, the integrated combustion assemblies **100*h* may transfer heat from the combusted fuel to the one or more elements or components of the heating unit 300. In one or more embodiments, a majority of heat transferred from one, some, or each of the combustion assemblies 100*h* may be transferred by radiation heat transfer. For example, the integrated combustion assemblies 100*h* may transfer heat from the combusted fuel to the walls 321, 322, 323, to the floor, to the roof, or combinations thereof of the heating unit 300 (e.g., infrared or radiant heat may be transferred from the respective flame holders of the integrated combustion assembly 300), which may subsequently radiate heat to one or more additional elements and/or components of the heating unit 300** to heat such elements and/or components.

While various aspects and embodiments have been disclosed herein, other aspects and embodiments are contemplated. The various aspects and embodiments disclosed herein are for purposes of illustration and are not intended to be limiting.

What is claimed is:

1. An integrated combustion assembly, comprising:

one or more fuel nozzles each of which is configured to output fuel flow in generally a downstream direction;

a fuel distribution hub operably coupled to the one or more fuel nozzles and configured to distribute fuel among the one or more fuel nozzles;

a perforated flame holder including a body defining a plurality of apertures that extend between an upstream side of the perforated flame holder and a downstream side of the perforated flame holder, the perforated flame holder being positioned at a selected distance downstream from the one or more fuel nozzles and defining a flow space between the upstream side of the perforated flame holder and the one or more nozzles; and one or more supports extending downstream from the one or more fuel nozzles and supporting the perforated flame holder at the selected distance from the one or more fuel nozzles.

2. The integrated combustion assembly of claim 1, further comprising a mounting flange connected to the one or more supports and configured to secure the integrated combustion assembly to a heating unit.

3. The integrated combustion assembly of claim 2, wherein the one or more supports include one or more openings in fluid communication with the flow space.

4. The integrated combustion assembly of claim 2, further comprising a flow control ring positioned below the mounting flange and having one or more openings that at least partially define inlets for oxidant to flow into the flow space.

5. The integrated combustion assembly of claim 4, wherein the flow control ring defines an interior space in fluid communication with the flow space and in fluid communication with the one or more openings in the flow control ring.

6. The integrated combustion assembly of claim 4, further comprising another flow control ring having one or more openings, the another flow control ring surrounding the flow control ring, and at least one of the one or more openings of the another flow control ring being at least partially aligned with the one or more openings of the flow control ring to define the inlets for oxidant to flow into the flow space.

7. The integrated combustion assembly of claim 2, wherein the fuel distribution hub is positioned below the mounting flange.

8. The integrated combustion assembly of claim 7, wherein the one or more fuel nozzles is at least partially positioned below the mounting flange.

9. The integrated combustion assembly of claim 1, wherein at least some of the one or more fuel nozzles are arranged along one or more circular paths.

10. The integrated combustion assembly of claim 9, wherein the one or more circular paths include a plurality of circular paths, at least some of which are concentric with each other.

11. The integrated combustion assembly of claim 1, wherein the one or more fuel nozzles includes two or more fuel nozzles configured to flow fuel into the flow space at two different spray angles.

12. The integrated combustion assembly of claim 11, wherein a bisector of at least one of the two different spray angles is oriented at a non-parallel angle relative to a center axis of the integrated combustion assembly.

13. The integrated combustion assembly of claim 1, further comprising a flame sensor positioned and configured to detect a flame in the flow space.

14. The integrated combustion assembly of claim 1, further comprising a flame sensor positioned and configured to detect a flame at or near the perforated flame holder.

15. The integrated combustion assembly of claim 1, further comprising a plurality of connector elements, each of which releasably secures a corresponding one of the one or more fuel nozzles at a selected location.

16. A heating unit, comprising:

a shell defining an interior space of the heating unit;

one or more integrated combustion assemblies extending into the interior space, each of the one or more integrated combustion assemblies including:

a plurality of fuel nozzles, each of which is configured to output fuel flow in generally a downstream direction;

a fuel distribution hub operably coupled to the plurality of fuel nozzles and configured to distribute fuel among the plurality of fuel nozzles;

a perforated flame holder including a body defining a plurality of apertures that extend between an upstream side of the perforated flame holder and a downstream side of the perforated flame holder, the perforated flame holder being positioned at a selected distance downstream from the plurality of fuel nozzles and defining a flow space between the upstream side of the perforated flame holder and the plurality of fuel nozzles; and one or more supports extending downstream from the plurality of fuel nozzles and supporting the perforated flame holder at the selected distance from the plurality of fuel nozzles.

17. The heating unit of claim 16, wherein each of the one or more integrated combustion assemblies includes a mounting flange connected to the one or more supports and secured to a bottom of the heating unit.

18. The heating unit of claim 17, wherein each of the one or more integrated combustion assemblies includes a flow control ring positioned below the mounting flange and having one or more openings that at least partially define inlets for oxidant to flow into the flow space.

19. The heating unit of claim 18, wherein each of the one or more integrated combustion assemblies includes another flow control ring having one or more openings, the another flow control ring surrounding the flow control ring, and at least one of the one or more openings of the another flow control ring being at least partially aligned with the one or more openings of the flow control ring to define the inlets for oxidant to flow into the flow space.

20. The heating unit of claim 17, wherein the fuel distribution hub of each of the one or more integrated combustion assemblies is positioned below the mounting flange.

21. The heating unit of claim 16, wherein at least some of the plurality of fuel nozzles of each of the one or more integrated combustion assemblies are arranged along one or more circular paths.

22. The heating unit of claim 16, wherein the one or more integrated combustion assemblies is a plurality of integrated combustion assemblies that are arranged along a substantially circular path.

23. A method of upgrading a heating unit, the method comprising:

removing at least one burner from the heating unit, thereby vacating a burner space therein; and installing an integrated combustion assembly in the vacated burner space in the heating unit, the integrated combustion assembly including:

a fuel distribution hub operably coupled to a plurality of fuel nozzles and configured to distribute fuel among the plurality of fuel nozzles, each of which is configured to output fuel flow in generally a downstream direction;

a perforated flame holder including a body defining a plurality of apertures that extend between an upstream side of the perforated flame holder and a downstream side of the perforated flame holder, the perforated flame holder being positioned at a selected distance downstream from the plurality of fuel nozzles and defining a flow space between the upstream side of the perforated flame holder and the plurality of fuel nozzles; and one or more supports extending downstream from the plurality of fuel nozzles and supporting the perforated flame holder at the selected distance from the plurality of fuel nozzles.

24. The method of claim 23, further comprising:

wherein the heating unit includes multiple burners; and maintaining one or more of the multiple burners operating while removing the at least one burner of the multiple burners from the heating unit.

25. The method of claim 23, wherein before installing the integrated combustion assembly in the vacated burner space in the heating unit, the integrated combustion assembly is preassembled.

26. The method of claim 25, wherein before removing the at least one burner from the heating unit, the integrated combustion assembly is preassembled.

* * * * *